US008469496B2

(12) United States Patent
Panchawagh et al.

(10) Patent No.: US 8,469,496 B2
(45) Date of Patent: Jun. 25, 2013

(54) LIQUID EJECTION METHOD USING DROP VELOCITY MODULATION

(75) Inventors: Hrishikesh V. Panchawagh, Rochester, NY (US); Michael A. Marcus, Honeoye Falls, NY (US); James A. Katerberg, Kettering, OH (US); Ali G. Lopez, Pittsford, NY (US); Shashishekar P. Adiga, Rochester, NY (US); Jeremy M. Grace, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 134 days.

(21) Appl. No.: 13/115,482

(22) Filed: May 25, 2011

(65) Prior Publication Data

US 2012/0300001 A1 Nov. 29, 2012

(51) Int. Cl.
*B41J 2/085* (2006.01)

(52) U.S. Cl.
USPC ..... 347/76

(58) Field of Classification Search
USPC ..... 347/73–82, 90
See application file for complete search history.

(56) References Cited

U.S. PATENT DOCUMENTS

| | | | | |
|---|---|---|---|---|
| 3,373,437 | A | 3/1968 | Sweet et al. | |
| 3,596,275 | A | 7/1971 | Sweet | |
| 4,068,241 | A | 1/1978 | Yamada | |
| 6,079,821 | A | 6/2000 | Chwalek et al. | |
| 6,235,212 | B1 | 5/2001 | Silverbrook | |
| 6,273,559 | B1 | 8/2001 | Vago et al. | |
| 6,312,110 | B1 | 11/2001 | Darty | |
| 6,450,619 | B1 | 9/2002 | Anagnostopoulos et al. | |
| 6,450,628 | B1 * | 9/2002 | Jeanmaire et al. | 347/75 |
| 6,509,917 | B1 | 1/2003 | Chwalek et al. | |
| 6,554,410 | B2 | 4/2003 | Jeanmaire et al. | |
| 6,588,888 | B2 | 7/2003 | Jeanmaire et al. | |
| 6,663,221 | B2 | 12/2003 | Anagnostopoulos et al. | |
| 6,746,108 | B1 * | 6/2004 | Jeanmaire | 347/82 |
| 6,793,328 | B2 * | 9/2004 | Jeanmaire | 347/74 |
| 6,827,429 | B2 * | 12/2004 | Jeanmaire et al. | 347/77 |
| 6,851,796 | B2 * | 2/2005 | Jeanmaire et al. | 347/74 |
| 7,192,121 | B2 | 3/2007 | Barbet et al. | |
| 7,364,276 | B2 | 4/2008 | Piatt et al. | |
| 7,712,879 | B2 | 5/2010 | Barbet | |
| 7,938,516 | B2 | 5/2011 | Piatt et al. | |
| 8,091,983 | B2 * | 1/2012 | Xie et al. | 347/77 |
| 2006/0139408 | A1 | 6/2006 | Barbet et al. | |
| 2009/0153627 | A1 | 6/2009 | Barbet | |
| 2009/0225112 | A1 | 9/2009 | Barbet | |
| 2009/0231398 | A1 | 9/2009 | Barbet | |
| 2010/0033542 | A1 | 2/2010 | Piatt et al. | |

* cited by examiner

*Primary Examiner* — Kristal Feggins
(74) *Attorney, Agent, or Firm* — William R. Zimmerli

(57) ABSTRACT

A liquid jet, ejected through a nozzle, is modulated using a drop formation device to cause the jet to form drop pairs, including first and second drops, traveling along a path separated in time on average by a drop pair period. A charging device, synchronized with the formation device, produces first and second charge states on the first and second drops, respectively, using a waveform including a period equal to the drop pair period and first and second distinct voltage states. A relative velocity of first and second drops from a selected drop pair is varied using a velocity modulation device to control whether the first and second drops of the selected drop pair form a combined drop having a third charge state. A deflection device causes the first, second, and combined drops having the first, second, and third charge states to travel along first, second, and third paths, respectively.

22 Claims, 18 Drawing Sheets

HEATER VOLTAGE
HIGH
LOW
91
92
DROP PAIR CYCLE NUMBER
0
1
2
3
4
5
97
CHARGE
ELECTRODE STATE
35
36
95
96
BREAK OFF EVENT
DELAY
93
Vmod VOLTAGE
94
NON-PRINT
PRINT

LIQUID EJECTION METHOD USING DROP VELOCITY MODULATION

CROSS REFERENCE TO RELATED APPLICATIONS

Reference is made to commonly-assigned, U.S. patent application Ser. No. 13/115,465, entitled "LIQUID EJECTION SYSTEM INCLUDING DROP VELOCITY MODULATION" filed concurrently herewith.

FIELD OF THE INVENTION

This invention relates generally to the field of digitally controlled printing systems, and in particular to continuous printing systems in which a liquid stream breaks into drops some of which are electrostatically deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed in a manner such that the liquid jet breaks up into drops of ink in a predictable manner. Printing occurs through the selective deflecting and catching of undesired ink drops. Various approaches for selectively deflecting drops have been developed including electrostatic deflection, air deflection, and thermal deflection.

In a first electrostatic deflection based CIJ approach, the liquid jet stream is perturbed in some fashion causing it to break up into uniformly sized drops at a nominally constant distance, the break-off length, from the nozzle. A charging electrode structure is positioned at the nominally constant break-off point so as to induce a data-dependent amount of electrical charge on the drop at the moment of break-off. The charged drops are then directed through a fixed electrostatic field region causing each droplet to deflect proportionately to its charge. The charge levels established at the break-off point thereby cause drops to travel to a specific location on a recording medium or to a gutter for collection and recirculation. This approach is disclosed by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure. A disclosure of a multi-jet CIJ printhead version utilizing this approach has also been made by Sweet et al. in U.S. Pat. No. 3,373,437 issued Mar. 12, 1968, Sweet '437 hereinafter. Sweet '437 discloses a CIJ printhead having a common drop generator chamber that communicates with a row (an array) of drop emitting nozzles each with its own charging electrode. This approach requires that each nozzle have its own charging electrode, with each of the individual electrodes being supplied with an electric waveform that depends on the image data to be printed. This requirement for individually addressable charge electrodes places limits on the fundamental nozzle spacing and therefore on the resolution of the printing system.

A second electrostatic deflection based CIJ approach is disclosed by Vago et al. in U.S. Pat. No. 6,273,559 issued Aug. 14, 2001, Vago '559 hereinafter. Vago '559 discloses a binary CIJ technique in which electrically conducting ink is pressurized and discharged through a calibrated nozzle and the liquid ink jets formed are broken off at two different time intervals. Drops to be printed or not printed are created with periodic stimulation pulses at a nozzle. The drops to be printed are each created with a periodic stimulation pulse that is relatively strong and causes the ink jet stream forming the drops to be printed to separate at a relatively short break off length. The drops that are not to be printed are each created with a periodic stimulation pulse that is relatively weak and causes the drop to separate at a relatively long break off length. Two sets of closely spaced electrodes with different applied DC electric potentials are positioned just downstream of the nozzle adjacent to the two break off locations and provide distinct charge levels to the relatively short break off length drops and the relatively long break off length drops as they are formed. The longer break off length drops are selectively deviated from their path by a deflection device because of their charge and are deflected by the deflection device towards a catcher surface where they are collected in a gutter and returned to a reservoir for reuse. Vago '559 also requires that the difference in break off lengths between the relatively short break off and the relatively long break off length be less than a wavelength ($\lambda$) that is the distance between successive ink drops or ink nodes in the liquid jet. This requires two stimulation amplitudes (print and non-print stimulation amplitudes) to be employed. Limiting the break off length locations difference to less than $\lambda$ restricts the stimulation amplitudes difference that must be used to a small amount. For a printhead that has only a single jet, it is quite easy to adjust the position of the electrodes, the voltages on the charging electrodes, and print and non-print stimulation amplitudes to produce the desired separation of print and non-print droplets. However, in a printhead having an array of nozzles part tolerances can make this quite difficult. The need to have a high electric field gradient in the droplet break off region makes the drop selection system sensitive to slight variations in charging electrode flatness, electrode thicknesses, and spacings that can all produce variations in the electric field strength and the electric field gradient at the droplet break off region for the different liquid jets in the array. In addition, the droplet generator and the associated stimulation devices may not be perfectly uniform down the nozzle array, and may require different stimulation amplitudes from nozzle to nozzle to produce particular break off lengths. These problems are compounded by ink properties that drift over time, and thermal expansion that can cause the charging electrodes to shift and warp with temperature. In such systems extra control complexity is required to adjust the print and non-print stimulation amplitudes from nozzle to nozzle to ensure the desired separation of print and non-print droplets. B. Barbet and P. Henon also disclose utilizing break off length variation to control printing in U.S. Pat. No. 7,192,121 issued Mar. 20, 2007.

B. Barbet in U.S. Pat. No. 7,712,879 issued May 11, 2010 discloses an electrostatic charging and deflection mechanism based on break off length and drop size. A split common charging electrode with a DC low voltage on the top section and a DC high voltage on the lower segment is utilized to differentially charge small drops and large drops according to their diameter.

T. Yamada in U.S. Pat. No. 4,068,241 issued Jan. 10, 1978, Yamada '241 hereinafter, discloses an inkjet recording device which alternately produces large drops and small drops. All drops are charged with a DC electrostatic field in the break off region of the liquid jet. Yamada '241 also changes the excitation drop magnitude of small drops not necessary for recording so that they will collide and combine with the large drops. Large drops and large drops combined with small drops are guttered and not printed while deflected small drops are printed. One of the disadvantages of this approach is that deflected drops are printed which could result in drop placement errors. Furthermore, as the smaller drop needs to be much smaller than the larger drop in order to be able create different charge states on each; higher nozzle diameter nozzles are required for producing the desired sizes of print drops. This limits the density of nozzle spacing that can be utilized in such an approach and severely limits the capability to print high resolution images.

As such, there is an ongoing need to provide a continuous printing system that electrostatically deflects selected drops, is tolerant of drop break off length, has a simplified design, and yields improved print quality.

SUMMARY OF THE INVENTION

It is an object of the invention to overcome at least one of the deficiencies described above by using mass charging and electrostatic deflection with a CMOS-MEMS printhead to create high resolution high quality prints while maintaining or improving drop placement accuracy and minimizing drop volume variation of printed drops.

Image data dependent control of drop formation via break off of each of the liquid jets and a charge electrode that has a image data independent time varying electrical potential, called a charge electrode waveform, are provided by the present invention. Drop formation is controlled to create pairs of drops using drop formation waveforms supplied to a drop formation device. The drop pairs are created at a drop pair period. The charge electrode waveform has a period equal to the drop pair period. The charge electrode waveform and the drop formation waveforms are synchronized with each other to alternately charge successive drops in one of two charge states. The drop formation waveforms can be selectively altered to control whether the drops of the drop pair merge to form a larger drop.

The present invention helps to provide system robustness by allowing larger tolerances on break-off time variations between jets in a long nozzle array. Additionally, at least every other drop is collected by a catcher helping to ensure that liquid remains on the catcher which reduces the likelihood of liquid splatter during operation. The present invention reduces the complexity of control of signals sent to stimulation devices associated with nozzles of the nozzle array. This helps to reduce the complexity of charge electrode structures and increase spacing between the charge electrode structures and the nozzles.

According to an aspect of the invention, a method of ejecting liquid drops includes providing liquid under pressure sufficient to eject a liquid jet through a nozzle of a liquid chamber. The liquid jet is modulated to cause portions of the liquid jet to break off into a series of drop pairs traveling along a path using a drop formation device. Each drop pair is separated in time on average by the drop pair period. Each drop pair includes a first drop and a second drop. A charging device is provided that includes a charge electrode associated with the liquid jet and a source of varying electrical potential between the charge electrode and the liquid jet. The source of varying electrical potential provides a waveform that includes a period that is equal to the drop pair period. The waveform also includes a first distinct voltage state and a second distinct voltage state. The charging device is synchronized with the drop formation device to produce a first charge state on the first drop and to produce a second charge state on the second drop. A relative velocity of a first drop and a second drop of a selected drop pair is varied using a drop velocity modulation device to control whether the first drop and the second drop of the selected drop pair combine with each other to form a combined drop. The combined drop has a third charge state. A deflection device is used to cause the first drop having the first charge state to travel along a first path, to cause the second drop having the second charge state to travel along a second path, and to cause the combined drop having the third charge state to travel along a third path.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
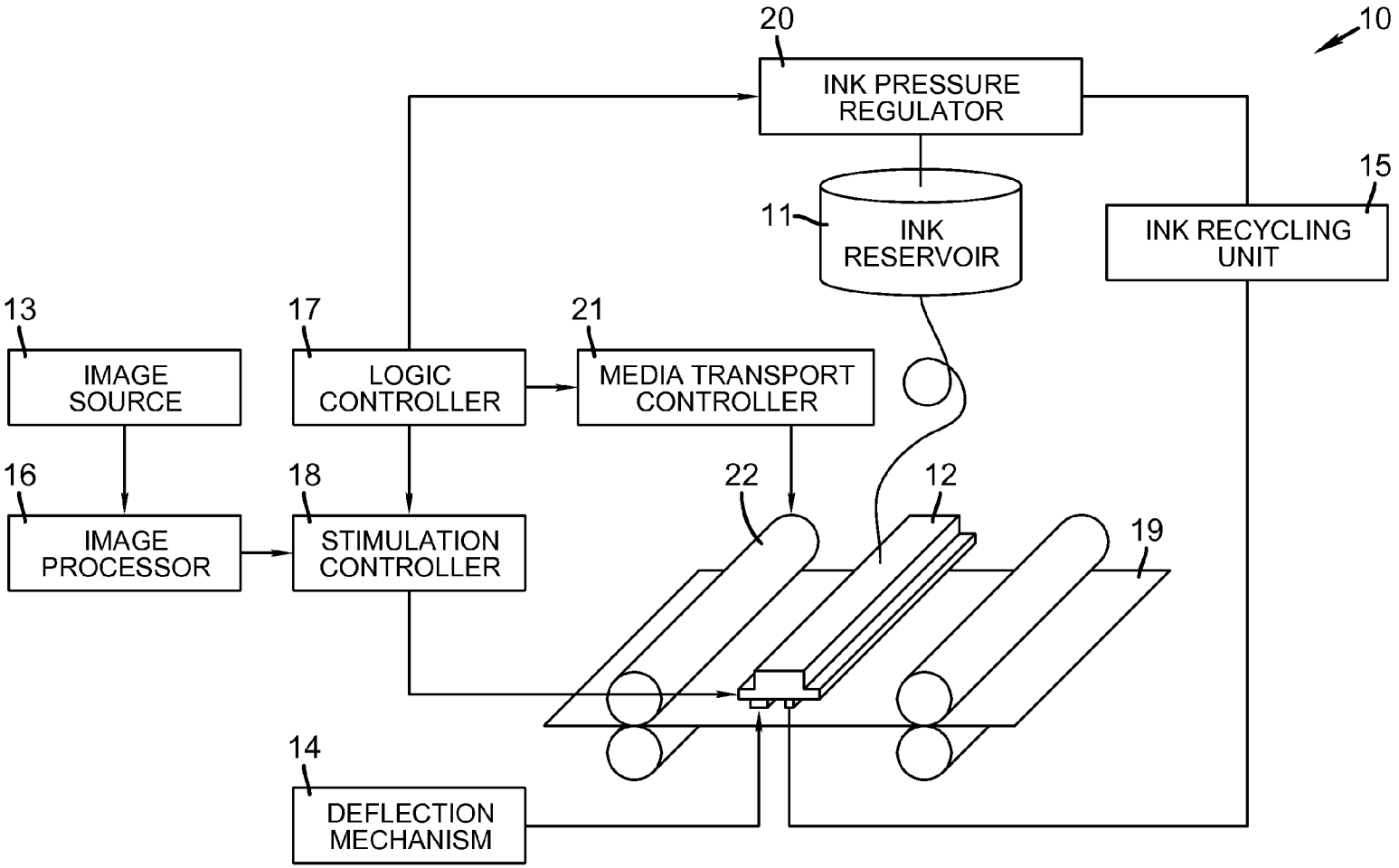
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, example embodiments of the present invention provide a printhead or printhead components typically used in inkjet printing systems. In such systems, the liquid is an ink for printing on a recording media. However, other applications are emerging, which use inkjet print heads to emit liquids (other than inks) that need to be finely metered and be deposited with high spatial resolution. As such, as described herein, the terms "liquid" and "ink" refer to any material that can be ejected by the printhead or printhead components described below.

Continuous ink jet (CIJ) drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a liquid jet of diameter dj, moving at a velocity vj. The jet diameter dj is approximately equal to the effective nozzle diameter do and the jet velocity is proportional to the square root of the reservoir pressure P. Rayleigh's analysis showed that the jet will naturally break up into drops of varying sizes based on surface waves that have wavelengths $\lambda$ longer than $\pi dj$, i.e. $\lambda \geqq \pi dj$. Rayleigh's analysis also showed that particular surface wavelengths would become dominate if initiated at a large enough magnitude, thereby "stimulating" the jet to produce mono-sized drops. Continuous ink jet (CIJ) drop generators employ a periodic physical process, a so-called "perturbation" or "stimulation" that has the effect of establishing a particular, dominate surface wave on the jet. The stimulation results in the break off of the jet into mono-sized drops synchronized to the fundamental frequency of the perturbation. It has been shown that the maximum efficiency of jet break off occurs at an optimum frequency $F_{opt}$ which results in the shortest time to break off. At the optimum frequency $F_{opt}$ (optimum Rayleigh frequency) the perturbation wavelength $\lambda$ is approximately equal to 4.5 dj. The frequency at which the perturbation wavelength $\lambda$ is equal to $\pi dj$ is called the Rayleigh cutoff frequency $F_R$, since perturbations of the liquid jet at frequencies higher than the cutoff frequency won't grow to cause a drop to be formed.

The drop stream that results from applying Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal can be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, can be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present invention. Thus the phrase "predetermined volume" as used to describe the present invention should be understood to comprehend that some small variation in drop volume about a planned target value may occur due to unpredictable satellite drop formation.

The example embodiments discussed below with reference to FIGS. 1-13 are described using particular combinations of components, for example, particular combinations of drop charging structures, drop deflection structures, drop catching structures, drop forming devices, and drop velocity modulating devices. It should be understood that these components are interchangeable and that other combinations of these components are within the scope of the invention.

Referring to FIG. 1, a continuous inkjet printing system 10 includes an ink reservoir 11 that continuously pumps ink into a printhead 12 also called a liquid ejector to create a continuous stream of ink drops. Printing system 10 receives digitized image process data from an image source 13 such as a scanner, computer or digital camera or other source of digital data which provides raster image data, outline image data in the form of a page description language, or other forms of digital image data. The image data from the image source 13 is sent periodically to an image processor 16. Image processor 16 processes the image data and includes a memory for storing image data. The image processor 16 is typically a raster image processor (RIP). Image data also called print data in image processor 16 that is stored in image memory in the image processor 16 is sent periodically to a stimulation controller 18 which generates patterns of time-varying electrical stimulation pulses to cause a stream of drops to form at the outlet of each of the nozzles on printhead 12, as will be described. These stimulation pulses are applied at an appropriate time and at an appropriate frequency to stimulation device(s) associated with each of the nozzles. The printhead 12 and deflection mechanism 14 work cooperatively in order to determine whether ink droplets are printed on a recording medium 19 in the appropriate position designated by the data in image memory or deflected and recycled via the ink recycling unit 15. The ink in the ink recycling unit 15 is directed back into the ink reservoir 11. The ink is distributed under pressure to the back surface of the printhead 12 by an ink channel that includes a chamber or plenum formed in a substrate typically constructed of silicon. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20.

One well-known problem with any type inkjet printer, whether drop-on-demand or continuous ink jet, relates to the accuracy of dot positioning. As is well-known in the art of inkjet printing, one or more drops are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printer drops are intended to be placed in desired locations within each pixel, for example in the center of each pixel area, for simple printing schemes, or, alternatively, in multiple precise locations within each pixel areas to achieve half-toning. If the placement of the drop is incorrect and/or their placement cannot be controlled to achieve the desired placement within each pixel area, image artifacts may occur, particularly if similar types of deviations from desired locations are repeated on adjacent pixel areas. The RIP or other type of processor 16 converts the image data to a pixel-mapped image page image for printing. During printing, recording medium 19 is moved relative to printhead 12 by means of a plurality of transport rollers 22 which are electronically controlled by media transport controller 21. A logic controller 17, preferably micro-processor based and suitably programmed as is well known, provides control signals for cooperation of transport controller 21 with the ink pressure regulator 20 and stimulation controller 18. The stimulation controller 18 comprises a drop controller that provides the drive signals for ejecting individual ink drops from printhead 12 to recording medium 19 according to the image data obtained from an image memory forming part of the image processor 16. Image data can include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

It can be appreciated that different mechanical configurations for receiver transport control can be used. For example, in the case of a page-width printhead, it is convenient to move recording medium 19 past a stationary printhead 12. On the other hand, in the case of a scanning-type printing system, it is more convenient to move a printhead along one axis (i.e., a main-scanning direction) and move the recording medium along an orthogonal axis (i.e., a sub-scanning direction), in relative raster motion.

Drop forming pulses are provided by the stimulation controller 18 which can be generally referred to as a drop controller and are typically voltage pulses sent to the printhead 12 through electrical connectors, as is well-known in the art of signal transmission. However, other types of pulses, such as optical pulses, can also be sent to printhead 12, to cause printing and non-printing drops to be formed at particular nozzles, as is well-known in the inkjet printing arts. Once formed, printing drops travel through the air to a recording medium and later impinge on a particular pixel area of the recording medium or are collected by a catcher as will be described.

Figure 2:
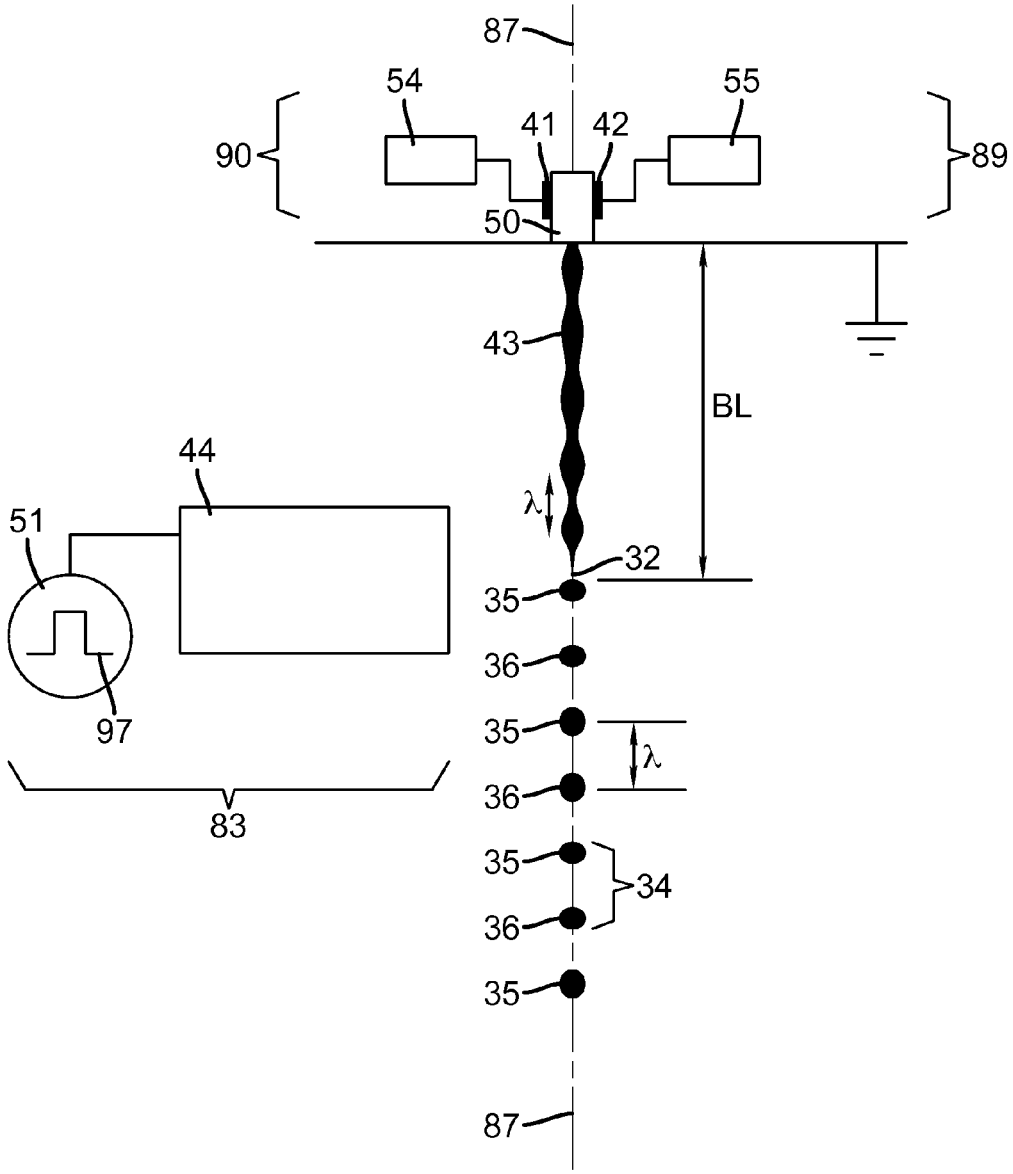
FIG. 2 shows an image of a liquid jet being ejected from a drop generator and its subsequent break off into drops with a regular period.

Referring to FIG. 2 the printing system has associated with it, a printhead that is operable to produce from an array of nozzles 50 an array of liquid jets 43. Associated with each liquid jet 43 is a drop formation device 89. The drop formation device includes a drop formation transducer 42 and a drop formation waveform source 55 that supplies a waveform to the drop formation transducer. The drop formation transducer can be of any type suitable for creating a perturbation on the liquid jet, such a thermal device, a piezoelectric device, a MEMS actuator, an electrohydrodynamic device, an optical device, an electrostrictive device, and combinations thereof. Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop formation waveform source supplies a waveform having a fundamental frequency $f_o$ and a fundamental period of $T_o=1/f_o$ to the drop formation transducer, which produces a modulation with a wavelength $\lambda$ in the liquid jet. The modulation grows in amplitude to cause portions of the liquid jet break off into drops. Through the action of the drop formation device, a sequence of drops are produced at a fundamental frequency $f_o$ with a fundamental period of $T_o=1/f_o$. In FIG. 2, liquid jet 43 breaks off into drops with a regular period at break off location 32, which is a distance BL from the nozzle 50. The distance between a pair of successive drops 35 and 36 is essentially equal to the wavelength $\lambda$ of the perturbation on the liquid jet. This sequence of drops breaking from the liquid jet forms a series of drop pairs 34, each drop pair having a first drop and a second drop. Thus, the frequency of formation of drop pair 34, commonly called a drop pair frequency $f_p$, is given by $f_p=f_o/2$ and the corresponding drop pair period is $T_p=2T_o$.

The creation of the drops is associated with an energy supplied by the drop formation device operating at the fundamental frequency $f_o$ that creates drops having essentially the same volume separated by the distance $\lambda$. Essentially the same volume typically means that the volume of one drop is within ±30% of the volume of the preceding drop, and more preferably the volume of one drop is within ±30% of the volume of the preceding drop. It is to be understood that although in the embodiment shown in FIG. 2, the first and second drops have essentially the same volume; the first and second drop may have different volumes such that pairs of first and second drop are generated on an average at a frequency of ½ $f_o$. For example, the volume ratio of the first drop to the second drop can vary from approximately 4:3 to approximately 3:4. The stimulation for the liquid jet 43 in FIG. 2 is controlled independently by a drop formation transducer associated with the liquid jet or nozzle 50. In one embodiment, the drop formation transducer 42 comprises one or more resistive elements adjacent to the nozzle. In this embodiment, the liquid jet stimulation is accomplished by sending a periodic current pulse of arbitrary shape, supplied by the drop formation waveform source through the resistive elements surrounding each orifice of the drop generator. The break off time of the drop for a particular inkjet nozzle can be controlled by at least one of the pulse amplitude or pulse duty cycle or pulse timing relative to other pulses in a sequence of pulses, to the respective resistive elements surrounding a nozzle orifice. In this way, small variations of either pulse duty cycle or amplitude allow the drop break off times to be modulated in a predictable fashion. Small changes in the amplitude or duty cycle of the stimulation controller to a resistive element surrounding an orifice of the drop generator also affect the velocity of the drop after it breaks off from the liquid jet.

Also shown in FIG. 2 is a charging device 83 comprising charging electrode 44 and charging pulse voltage source 51. The charge electrode 44 associated with the liquid jet is positioned adjacent to the break off point 32 of the liquid jet 43. If a voltage is applied to the charge electrode 44, the electric fields produced between the charge electrode and the electrically grounded liquid jet, the capacitive coupling between the two produces a net charge on the end of the electrically conductive liquid jet. (The liquid jet is grounded by means of contact with the liquid chamber of the grounded drop generator.) If the end portion of the liquid jet breaks off to form a drop while there is a net charge on the end of the liquid jet, the charge of that end portion of the liquid jet is trapped on the newly formed drop.

Figures 10A, 10B, 10C:
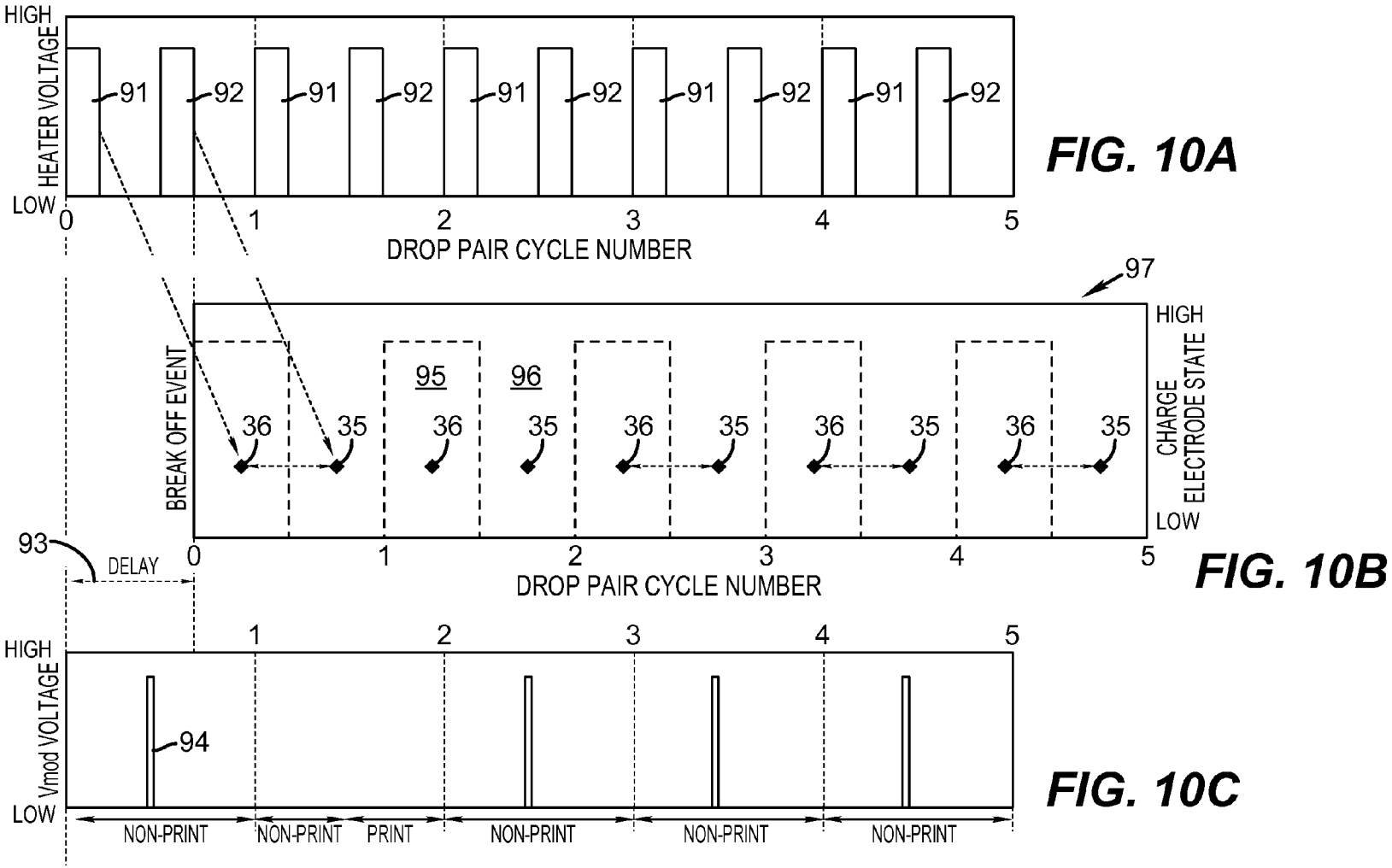
FIG. 10 shows a first example embodiment of a timing diagram illustrating drop formation pulses, velocity modulating pulses, the charge electrode waveform, and the break off of drops.

The voltage on the charging electrode 44 is controlled by a charging pulse source 51 which provides a two state waveform operating at the drop pair frequency $f_p$ given by $f_p=f_o/2$, that is half the fundamental frequency or equivalently at a drop pair period $T_p=2T_o$, that is twice the fundamental period $2T_o$ to produce two distinct charge states on successively formed drops 35 and 36. Thus, the charging pulse voltage source 51 provides a varying electrical potential between the charging electrode 44 and the liquid jet 43. The source of varying electrical potential generates a charge electrode waveform 97, the charge electrode waveform has a period that is equal to the drop pair period, and the charge electrode waveform includes a first distinct voltage state and a second distinct voltage state. In a preferred embodiment, each voltage state of the charge electrode waveform 97 is active for a time interval equal to the fundamental period. This waveform supplied to the charge electrode is independent of, or not responsive to, the image data to be printed. The charging device 83 is synchronized with the drop formation device so that a fixed phase relationship is maintained between the charge electrode waveform produced by the charging pulse voltage source 51 and the clock of the drop formation waveform source. As a result, the phase of the break off of drops from the liquid stream, produced by the drop formation waveforms, is phase locked to the charge electrode waveform. As indicated in FIG. 10, there can be a phase shift, denoted by delay 93, between the charge electrode waveform and the drop formation waveforms. The phase shift is set such that for each drop pair produced, the first drop breaks off from the jet while the charge electrode is in the first voltage state, yielding a first charge state with a first charge to mass ratio on the first drop 36, and the second drop of the drop pair breaks off from the jet while the charge electrode is in the second voltage state, to produce a second charge state with a second charge to mass ratio on the second drop 35 of the drop pair.

In the figures FIG. 5A-7B, the first drop 36 having a first charge state is illustrated as possessing a negative charge and the second drop 35 having a second charge state is shown to being uncharged. It is to be understood that the first and second charge states are limited to this embodiment. In an alternate embodiment, first and second waveform states are configured to cause the first drop to be positively charged rather than negatively charged. In other embodiments, the first charge state corresponds to an uncharged drop state and the second charge state corresponds to the second drop being charged. In still other embodiments, the first charge state could have one polarity of charge and the second charge state could have a charge of the opposite polarity. The magnitude of the first and second charges can be the same or different.

Associated with the liquid jet is a drop velocity modulation device 90. The drop velocity modulation device is made up of a drop modulation device transducer 41 and a velocity modulation source 54. The drop velocity modulation transducer can be of a thermal device, a piezoelectric device, a MEMS actuator, and an electrohydrodynamic device, an optical device, an electrostrictive device, and combinations thereof. Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop velocity modulation device is employed to selectively alter or modulate the velocity of the first drop, the second drop, or both drops in a drop pair to cause the first and second drop in a drop pair to merge. As small changes in the amplitude, the duty cycle, waveform of the energy pulses transferred to the liquid jet to form the drops affect the velocity of the formed drops, the velocity of one or both drops in a drop pair can be modulated and is accomplished by altering the characteristics of the energy transferred to the liquid jet that created the perturbation on the liquid jet that cause the drops to break off from the liquid stream. The drop velocities of the drops in a drop pair are selectively modulated in response to the print or image data supplied to the velocity modulation source. Thus the drop velocity modulation waveform depends on the print or image data. In some embodiments, the velocity of one of the drops in the drop pair is modulated, while the velocity of the other drop remains unchanged. In other embodiments, the velocities of both drops are modulated.

Figure 3:
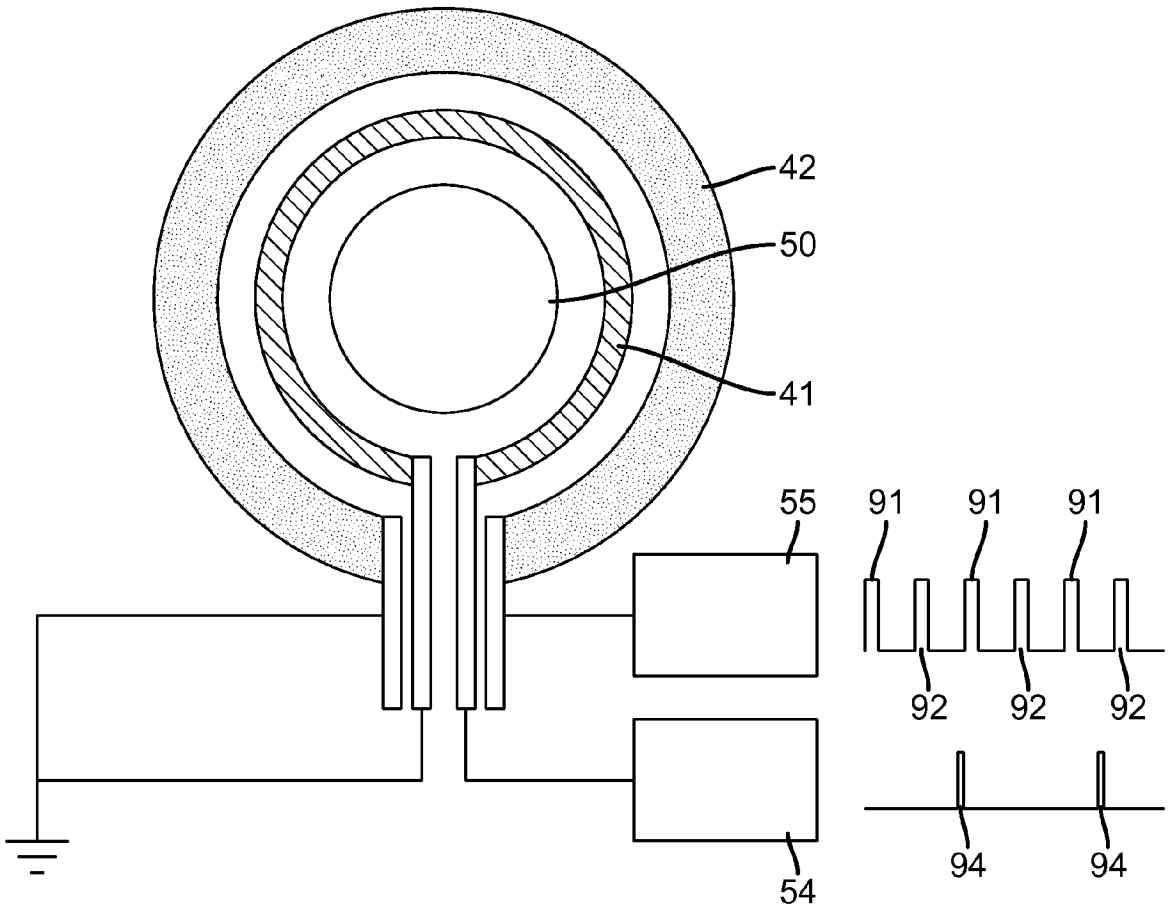
FIG. 3 is a simplified block schematic diagram of a nozzle and associated drop formation device and velocity modulation device according to an example embodiment of the invention.

The needed small changes in the amplitude, the duty cycle, waveform of the energy pulses transferred to the liquid jet to affect the velocity of the formed drops are provided in some embodiments by means of a velocity modulation device transducer 41, driven by a velocity modulation source 54 that are distinct from the drop formation device transducer 42 and the drop formation source 55. FIG. 3 shows one such embodiment, in which the velocity modulation device transducer 41 and the drop formation device transducer 42 are separate heaters concentrically placed around the nozzle 50. The drop formation device transducer 42, receiving an image-data independent sequence of pulses from the drop formation source 55, transfers a regular sequence of energy pulses to the liquid jet flowing through the nozzle 50. This sequence of pulses form a sequence of pulse pairs made up of a first drop forming pulse 91 and a second drop forming pulse 92. The velocity modulation device transducer 41 transfers a image data dependent sequence of energy pulses to the liquid jet flowing through the nozzle 50 as a result of the image data dependent sequence of velocity modulating pulses 94 supplied by the velocity modulation source 54.

Figure 4:
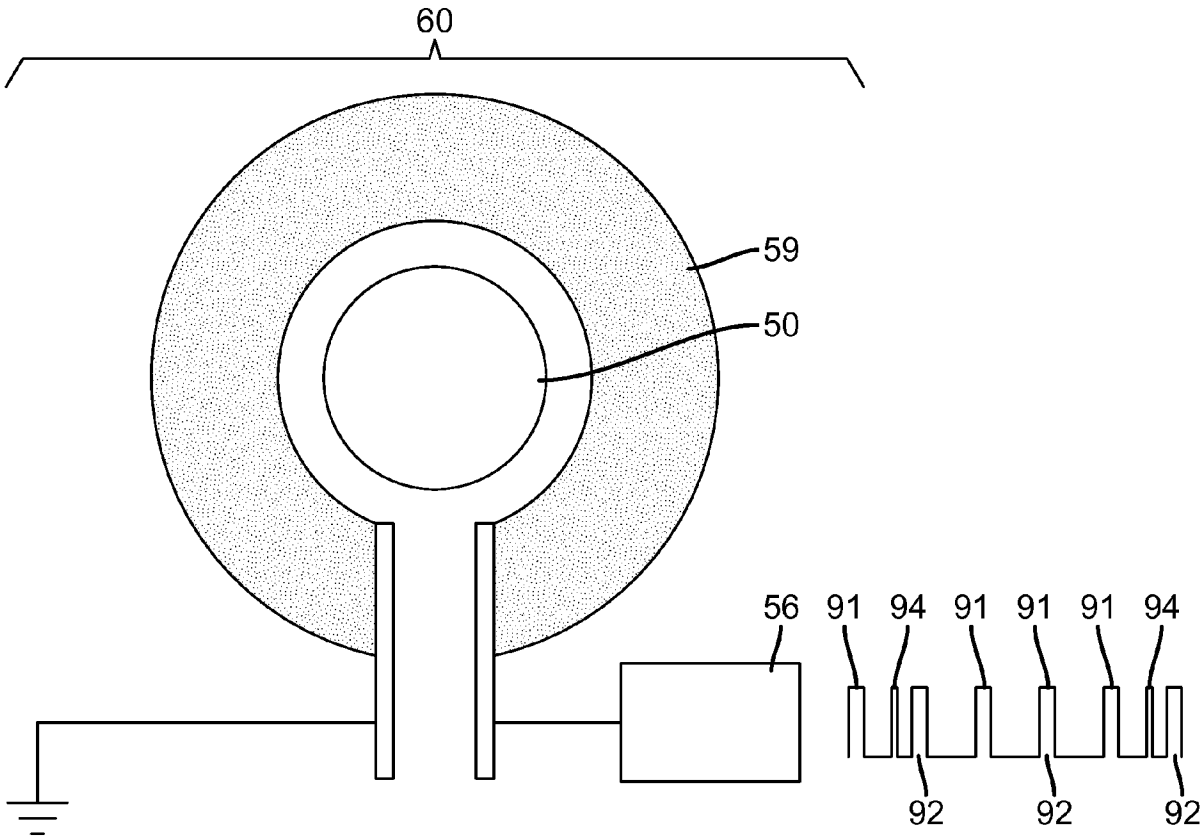
FIG. 4 is a simplified block schematic diagram of a nozzle and an associated stimulation device according to another example embodiment of the invention.

In other embodiments, the drop formation device 89 and the velocity modulation device 90 are the same device, commonly referred to as a stimulation device 60, shown in FIG. 4. The stimulation device 60 is made up of a stimulation waveform source 56 and a stimulation transducer 59. In this embodiment, a stimulation waveform source 56 serves as both the drop formation waveform source and the velocity modulation source. A stimulation transducer 59 serves as both the drop formation device transducer and the velocity modulation device transducer. The stimulation waveform source 56 provides a waveform having first and second drop forming pulses 91 and 92, respectively and well as velocity modulating pulses 94 to the stimulation transducer 59.

In other embodiments, the drop formation device and the drop velocity modulation devices are the same device. In such embodiments a single transducer is employed to both form the drops and to modulate their velocity. A common waveform source provides the pulses to the transducer for forming drops and alters the amplitude or pulse width of selected pulses to modulate the velocity of selected drops. Alternatively the common waveform source can insert one or more narrow pulses between regularly spaced drop formation pulses to modulate the velocity of one or more drops. In such embodiments the waveform supplied to the stimulation device depends on the image data.

FIG. 5A-7B show various embodiments of a continuous liquid ejection system described in detail herein. The continuous liquid ejection systems embodiments include most of the components described with reference to the continuous inkjet system shown in FIG. 1. All of the continuous liquid ejection system embodiments 40 include a liquid chamber in fluid communication with a nozzle 50 or nozzle array. (In these figures, the array of nozzles would extend into and out of the plane of the figure.) The liquid chamber contains liquid under pressure sufficient to eject liquid jets 43 through the nozzles. Each of the liquid jets has a drop formation device 89 associated with it. The drop formation device includes a drop formation device transducer 42 and a drop formation waveform source 55 operable to produce a modulation in the liquid jet to cause portions of the liquid jet to break off into a series of drop pairs including a first drop 36 and a second drop 35 traveling along a path. Each drop pair is separated in time on average by twice the fundamental period.

The continuous liquid ejection system also includes a charging device including a charge electrode 44, or 45 associated with the array of liquid jets and a source of varying electrical potential 51 between the charge electrode and the liquid jets. The source of varying electrical potential 51 applies a charge electrode waveform 97 with a period that is equal to the drop pair period to the charge electrode. The waveform includes a first distinct voltage state and a second distinct voltage state. As discussed relative to FIG. 2, the charge electrode 44 is positioned so that it is adjacent to the break off locations of the liquid jets in the nozzle array. The charging device is synchronized with the drop formation device so that the first voltage state is active when the first drop of a drop pair breaks off adjacent to the electrode and the second voltage state is active when the second drop of the drop pair breaks off adjacent to the electrode. As a result of the electric fields produced by the charge electrode in the first and second voltage states, a first charge state is produced on the first drop and a second charge state on the second drop of each drop pair.

The continuous liquid ejection system also includes a drop velocity modulation device 42 associated with each liquid jet 43. The drop velocity modulation device varies the relative velocity of a first drop 36 relative to the second drop 35 of selected drop pairs such that the first drop and the second drop of the selected drop pairs combine with each other to form a third drop 49, also called a combined or merged drop 49, as shown in FIG. 5B. The drops of the selected drop pairs merge at the drop merge location 31 between the up and down arrows, as shown in FIG. 5B. Selection of drop pairs for velocity modulation leading to the merging of the first and second drop is typically based on the print data received by the stimulation control 18 from the image processor 16. Since the first drop is in a first charge state and the second drop is in a second charge state, the resulting combined drop has a third charge state. The continuous liquid ejection system also includes a deflection device 14 that causes the first drop having the first charge state to travel along a first path 38, the second drop having the second charge state to travel along a second path 37 and the combined drop having a third charge state to travel along a third path 39.

Figure 5A:
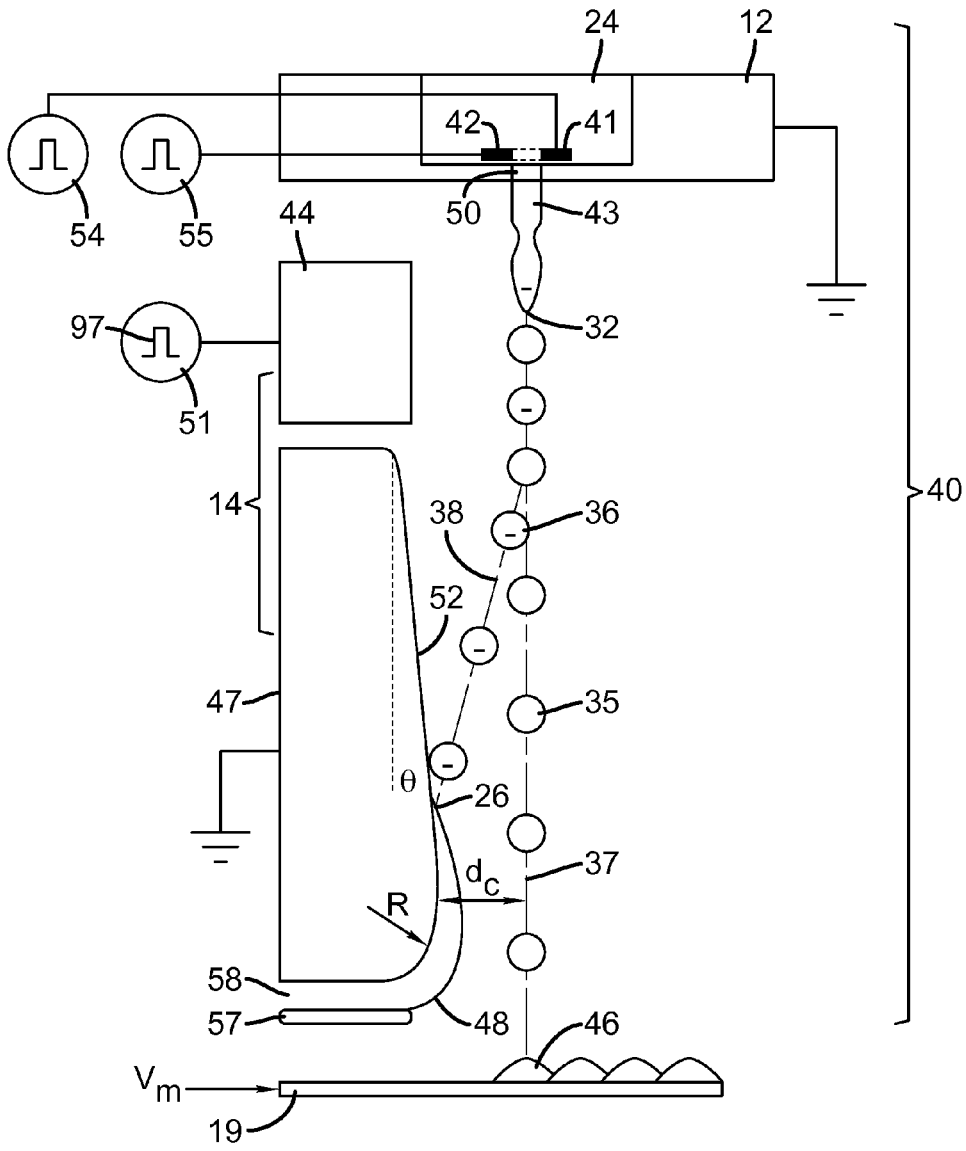
FIG. 5A shows a cross sectional viewpoint through a liquid jet of a first embodiment of the continuous liquid ejection system according to this invention and operating in an all print condition.
Figure 5B:
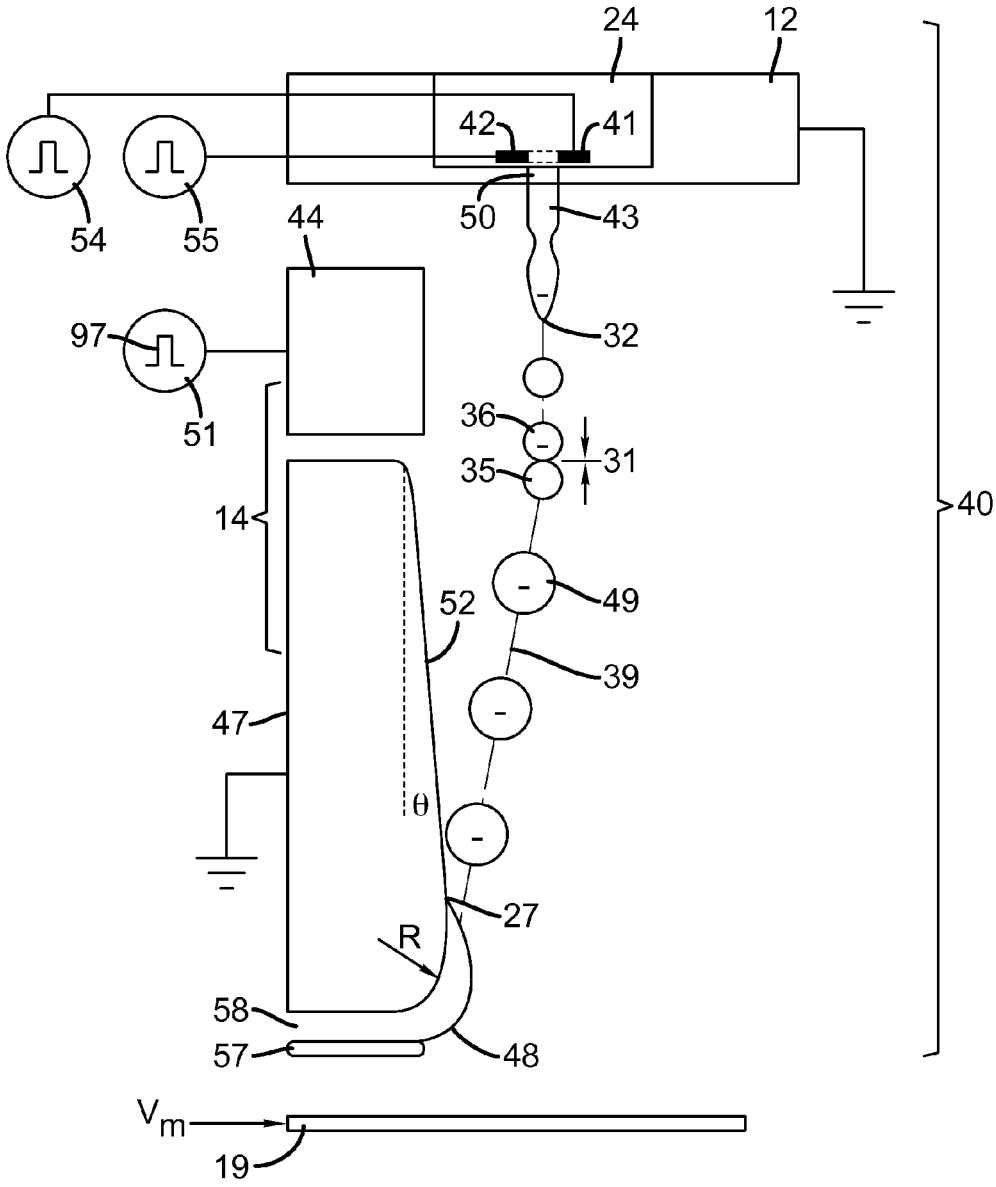
FIG. 5B shows a cross sectional viewpoint through a liquid jet of a first embodiment of the continuous liquid ejection system according to this invention and operating in a no print condition.
Figure 5C:
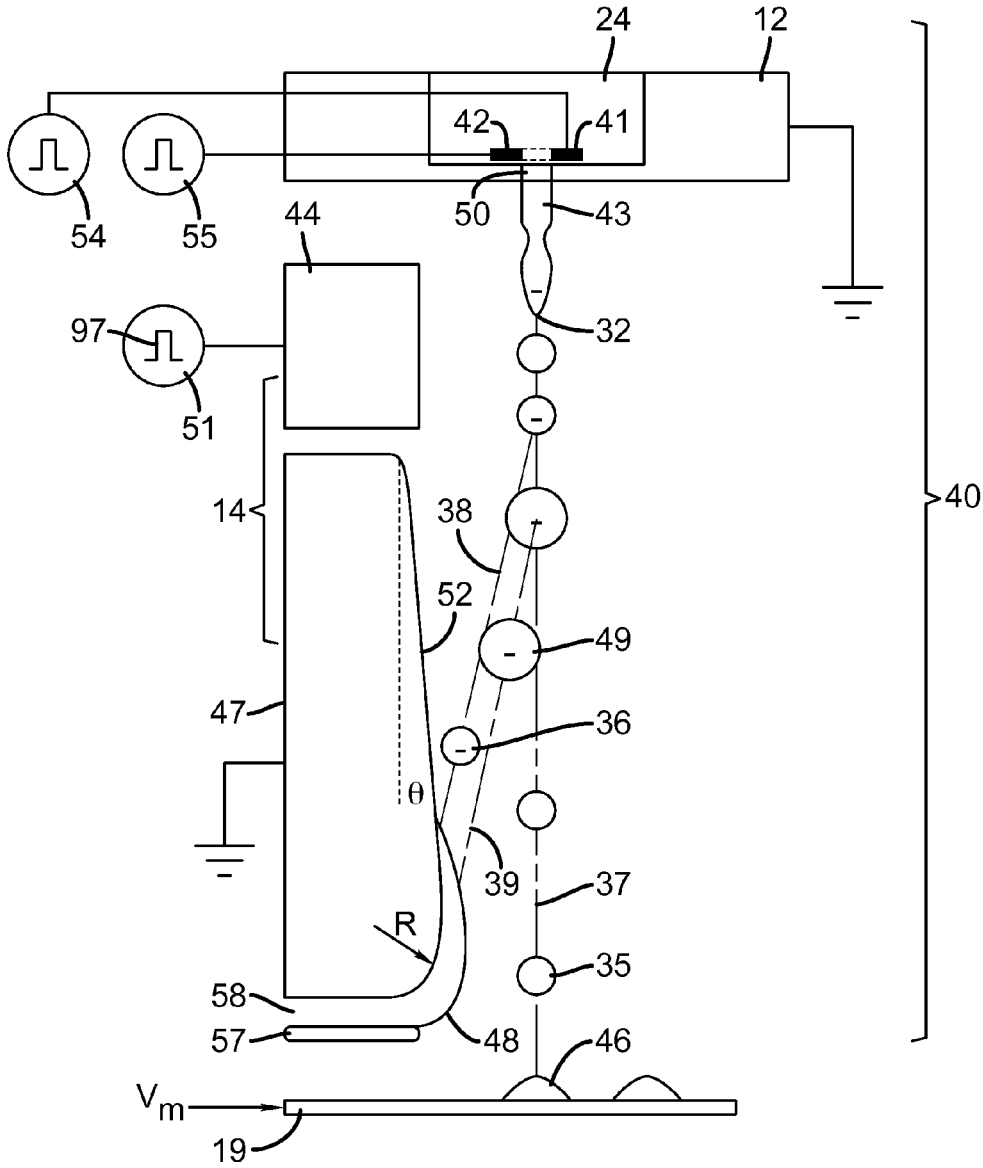
FIG. 5C shows a cross sectional viewpoint through a liquid jet of a first embodiment of the continuous liquid ejection system according to this invention and illustrates a general print condition.

In the embodiment shown in FIG. 5A-5C, the charge electrode 44 is part of the deflection device 14. The electrically biased charge electrode 44 located to one side of the liquid jet adjacent to the break off point, not only attracts a charge to the end of the jet prior to the break off of a drop, but also attracts charged drops after they break off from the liquid jet. This deflection mechanism has been described in J. A. Katerberg, "Drop charging and deflection using a planar charge plate", 4th International Congress on Advances in Non-Impact Printing Technologies. The catcher 47 also makes up a portion of the deflection device 14. As described in U.S. Pat. No. 3,656,171, charged drops passing in front of a conductive catcher face cause the surface charges on the conductive catcher face 52 to be redistributed in such a way that the charged drops are attracted to the catcher face 52. As the charge plate in this embodiment begins to deflect the first and second drops so that they begin following the first and second paths, respectively, as they are breaking off and immediately thereafter, the first and second drops of the drop pair that undergo velocity modulation begin to travel along the first and second paths before they merge to form the combined drop. The velocity modulation must be sufficient to cause the first and second drops to merge before the divergence of the first and second paths would prevent them from merging.

Figure 6A:
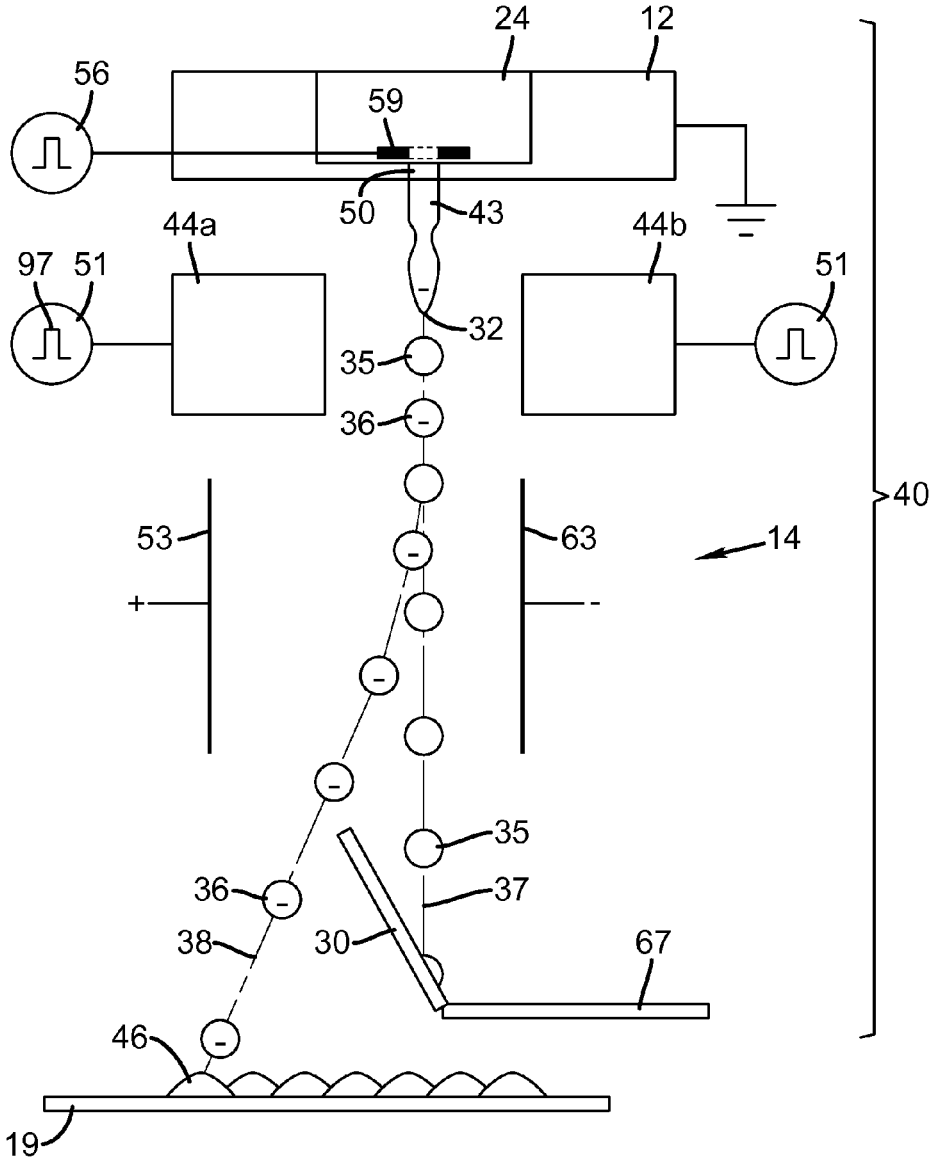
FIG. 6A shows a cross sectional viewpoint through a liquid jet of an alternate embodiment of the continuous liquid ejection system according to this invention and operating in an all print condition.
Figure 6B:
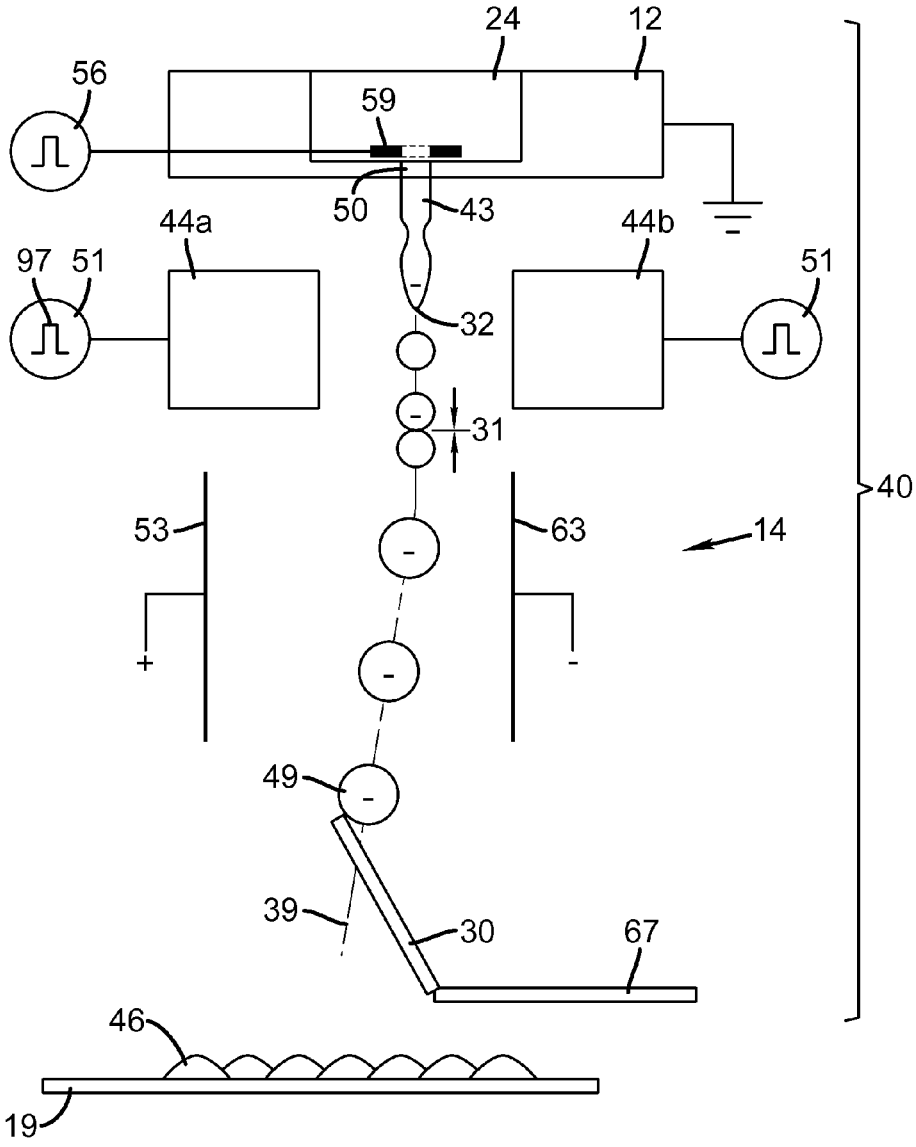
FIG. 6B shows a cross sectional viewpoint through a liquid jet of an alternate embodiment of the continuous liquid ejection system according to this invention and operating in a no print condition.
Figure 6C:
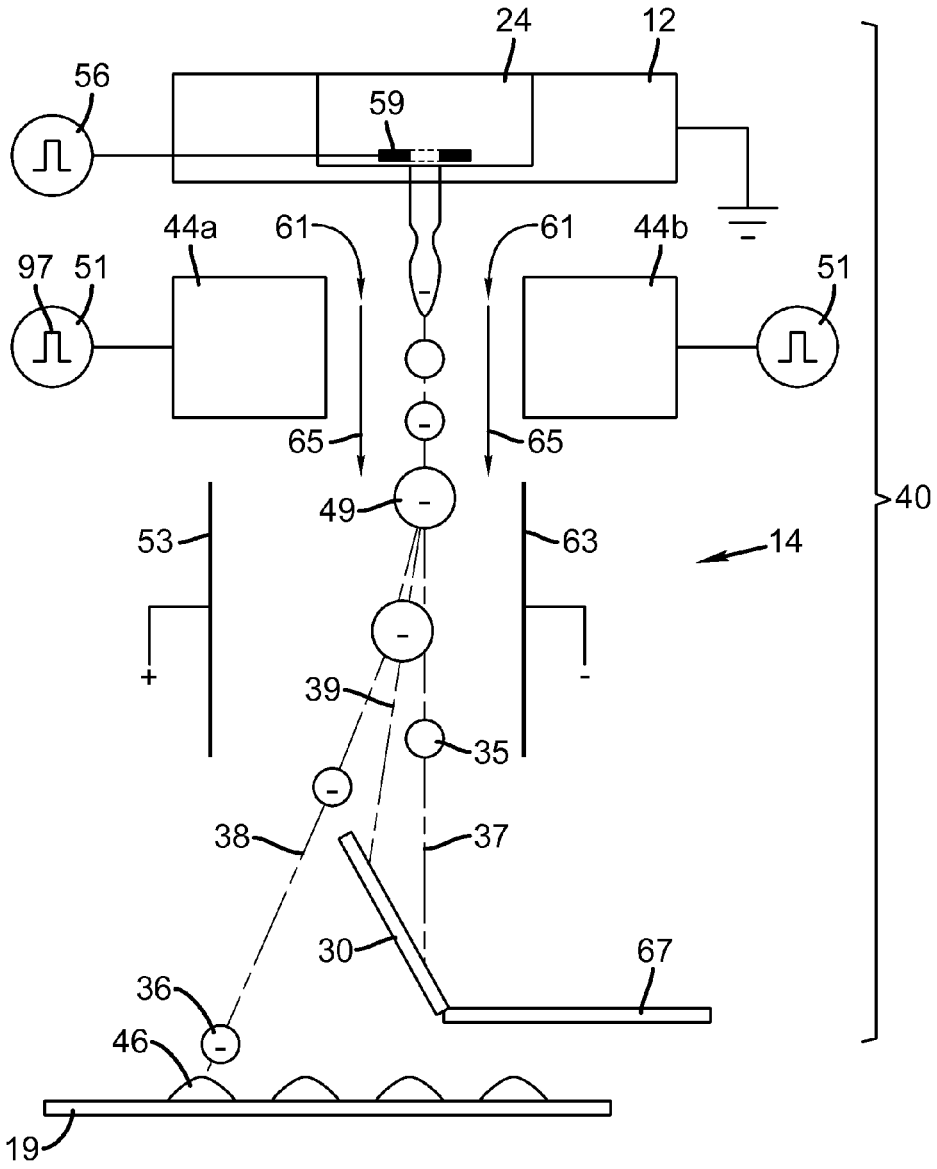
FIG. 6C shows a cross sectional viewpoint through a liquid jet of an alternate embodiment of the continuous liquid ejection system according to this invention and operating in a general print condition.

In order to selectively print drops onto a substrate one or more catchers are utilized to intercept drops traveling down two of the first, second and third paths. FIG. 5A-5C and FIG. 7A-7B show embodiments in which the catcher intercepts drops traveling along the first and third paths while drops traveling down the second path are allowed to contact a substrate and be printed. FIG. 6A-6C show an embodiment in which the catcher intercepts drops traveling along the second and third paths while drops traveling down the first path are allowed to contact a substrate and be printed. Other embodiments can include the use of two catchers to intercept drops traveling along any two paths of the first, second and third paths individually while drops traveling along the remaining path of the first, second and third paths are allowed to contact a substrate and be printed.

FIG. 5A-5C show cross sectional views of the main components of a continuous liquid ejection system and demonstrate different print modes of a first embodiment of this invention. The continuous liquid ejection system includes a printhead 12 comprising a liquid chamber 24 in fluid communication with an array of one or more nozzles 50 for emitting liquid streams 43. Associated with each liquid jet are a drop formation device transducer 42 and a velocity modulation device transducer 41. In the embodiments shown, the drop formation device transducer 42 and a velocity modulation device transducer 41 are formed in the wall around the nozzle 50. Separate drop formation device transducers 42 can be integrated with each of the nozzles in a plurality of nozzles or a common drop formation device transducer 42 can be used for a plurality of nozzles. Velocity modulation device transducer 41 is integrated with each of the nozzles in a plurality of nozzles. The drop formation device transducer 42 is actuated by a drop formation waveform source 55 which provides the periodic stimulation of the liquid jet 43 at the fundamental period $T_o$. The velocity modulation device transducer 41 can also be actuated by a separate velocity modulation source 54. In some embodiments of the printhead, the drop formation device transducer 42 and the velocity modulation device transducer 41 can be the same transducer element and the drop formation waveform source 55 and the velocity modulation source 54 can comprise the same source. Printhead 12, commonly referred to as a MEMS-CMOS printhead, is advantaged in that it can be easily integrated with the digital printing system. The silicon-based printhead includes an array of nozzles that are individually addressed to cause jet break-up and selective formation of print and non-print drops. This feature enables higher nozzle densities to create high resolution prints.

A grounded catcher 47 is positioned below the charge electrode 44. The purpose of catcher 47 is to intercept or gutter charged drops so that they will not contact and be printed on print medium or substrate 19. For proper operation of the printhead 12 shown in FIG. 5A and subsequent figures the catcher 47 and/or the catcher bottom plate 57 are grounded to allow the charge on the intercepted drops to be dissipated as the ink flows down the catcher face 52 and enters the ink return channel 58. The face 52 of the catcher 47 makes an angle θ with respect to the liquid jet axis 87 which is shown in FIG. 2. As shown in FIG. 5A charged drops 36 are thus attracted to catcher face 52 of grounded catcher 47. Drops 36 intercept the catcher face 52 at charged drop catcher contact point 26 to form an ink film 48 traveling down the face of the catcher 47. The bottom of the catcher has a curved surface of radius R, includes a bottom catcher plate 57 and an ink recovery channel 58 above the bottom catcher plate 57 for capturing and recirculation of the ink in the ink film 48. If a positive voltage potential difference exists from the electrode 44 to the liquid jet 43 at the time of break off of a drop breaking off adjacent to the electrode, a negative charge will be induced on the forming drop that will be retained after break off of the drop from the liquid jet. If no voltage potential difference exists from the electrode 44 to the liquid jet 43 at the time of break off of a drop it would be expected that no charge will be induced on the forming drop that will be retained after break off of the drop from the liquid jet. However, as the second drop 35 breaking off from the liquid jet is capacitively coupled to the charged first drop 36, a small charge can be induced on the second drop even when the charge electrode is at 0 V in the second charge state. The individual drops are sequentially formed at the fundamental frequency $f_o$ with fundamental period $T_o$ and the two-drop drop pairs are formed at a frequency of $f_o/2$ with a period of $2T_o$.

For simplicity in understanding the invention, the FIG. 5A-5C and subsequent figures are drawn for the case where the second charge state is near zero charge so that there is little or no deflection of the second drop of a drop pair 35 as shown by the direction of the second path 37. For simplicity in understanding the second path 37 is drawn to correspond with the liquid jet axis 87 shown in FIG. 2. The first drop 36 of a drop pair 34 is in a high charge state so that the first drops 36 are deflected as they travel along the first path 38. This invention thus allows printing of one print drop per drop pair cycle, at the drop pair frequency $f_p=f_o/2$ or at drop pair period $T_p=2T_o$. We define this as a small drop print mode which enables printing of alternate drops formed at the fundamental frequency $f_o$ which can be tuned to the optimum frequency for jet break off; as opposed to a large drop printing mode in which the large combined drops are used for printing.

As described above a small charge can be induced on the second drop even when the charge electrode is at 0 V in the second charge state. The second drop can therefore undergo a small deflection. In certain embodiments, the charge induced on the second drop by the charge of the first drop is neutralized by altering the second voltage state of the charge electrode waveform. Rather than use 0 volts at the second voltage state, a small offset from 0 volts is used. The offset voltage is selected so that the charge induced on the drop breaking off adjacent to the charge electrode during the second voltage state has the same magnitude and of opposite polarity to the charge induced on the drop breaking off by the preceding drops. The result is a drop with essentially no charge that undergoes essentially no deflection due to electrostatic forces. The amount of DC offset depends on the specific configuration of the system including, for example, whether one charging electrode or two charging electrodes are used in the system, or the geometry of the system including, for example, the relative positioning of the jet and the charging electrode(s) and the distances between neighboring drops. Typically, the range of the second voltage state to the first voltage state is between 50% and 10%. For example, in some applications when the first voltage state includes 200 volts, the second voltage state includes a DC offset of 50 volts (25% of the first voltage state).

Successive drops 35 and 36 are considered to be a drop pair with the first drop of a drop pair 36 being charged by a charge electrode to a first charge state and the second drop of the drop pair 35 being charged to a second charge state by the charge electrode. FIG. 5A shows an all print condition in which a long sequence of drop pairs are formed and in which no velocity modulation has been carried out of the velocity modulation device. Without velocity modulation, the first and second drops in each drop pair have the same velocity, and therefore the second drop doesn't merge with the first drop in the drop pair. Due to the different charge on these two drops, they undergo different amounts of deflection due to the deflection device 14. The first drop 36 is deflected to follow the first path 38 while the second drop 35 follows the second path 37 to strike the recording media 19. FIG. 5B shows a no print condition in which a long sequence of drop pairs are formed. The velocity modulation device transducer has varied the relative velocity of the first and second drops in each drop pair causing the two drops of each drop pair to combine into a larger combined drop 49. The combined third drop 49 has a net charge that is equal to the sum of the charge on the first drop 36 and the charge on the second drop 35. The net charge on the third drop corresponds to a third charge state. The deflection device acts on the combined drop 49 having a third charge state, causing the combined drop to travel along a third path. As the combined drop has a different charge to mass ratio than either of the first and second drops, it undergoes a different amount of deflection than the first and second drops, As a result, the combined drop travels along a third path that will be different than the first and second paths. The catcher is positioned to intercept the third path so all the combined or merged drops get intercepted by the catcher. FIG. 5C shows a normal print sequence in which the velocity modulation device has selectively acted on the drop pairs so that some the drops of some drop pairs do not merge, to yield a print drop and a guttered drop and the first and second drops of other drops pairs do merge and are deflected to the gutter.

FIG. 5A shows a cross sectional viewpoint through a liquid jet 43 of a first embodiment of the continuous inkjet system according to this invention and illustrates a sequence of drop pairs in an all print condition with the second drop 35 of a sequential pair of drops being charged by charge electrode 44 to a second charge state and not being attracted to a catcher 47 and are printed on recording medium 19 as a sequence of printed drops 46 and the first drop 36 of the drop pair being charged to a first charge state by the charge electrode 44 and are attracted to the catcher 47 and are not printed. For the drops being produced as shown in FIG. 5A successive drops are created at the fundamental period by stimulation of drop formation waveform source 55 at the fundamental period $T_o$. The drop velocity modulation device 41 has not acted on the liquid jet, so all the drops have the same drop velocity. As a result the first and second drops in the drop pairs do not merge. An appropriate waveform being applied to electrode 44A would be a square wave of 50% duty cycle with a period equal to the drop pair period $T_p=2T_o$ and a positive voltage in the high state and ground at the low state. During normal printing the recording medium 19 would be moving to the right at a velocity $v_m$ as shown in FIG. 5A.

FIG. 5B shows a cross sectional viewpoint through a liquid jet 43 of a first embodiment of the continuous inkjet system according to this invention and illustrates a sequence of drop pairs in a no print condition with the first drop of a sequential pair of drops being charged by a charge electrode to a first charge state and the second drop of the drop pair being charged to a second charge state with pairs of alternate drops being merged at a merge location 31 located a distance $d_m$ from the outlet of nozzle 50 into a sequence of combined drops 49 in a third charge state which are also attracted to and intercepted by the catcher 47 and are not printed. The combined drops 49 have essentially the same charge as the charged drops 36 shown in FIG. 5A, but have essentially twice the mass of drops 35 and 36. The combined drops 49 are also deflected when they travel adjacent to the catcher 47 and will strike the catcher face 52 at charged drop catcher contact point 27 which is lower down on the catcher face 52 than contact point 26 of single charged drops 36 to form an ink film 48 traveling down the face of the catcher 47. The drops 35 and 36 of a drop pair shown in FIG. 5B combine because the velocities of the two drop are different, typically differing by 2-20%. This is a result of applying energy from the velocity modulation source 54 to power the velocity modulation device transducer 41 during the formation of one of the drops of a drop pair or changing the waveform applied to drop formation waveform source 55 during the drop formation of one of the drops of a drop pair to provide greater thermal energy to the drop formation device transducer 42 of a thermal printhead. Thus, as is shown in FIG. 5B in a sequence of drop pairs in the no print condition all drop pairs are combined and guttered and no print drops 46 occur on the recording medium 19. In order to ensure that all drops are properly guttered the merge distance $d_m$ should be preferably less than the distance from the outlet of the nozzle 50 to the top of the catcher 59.

FIG. 5C shows a cross sectional viewpoint through a liquid jet of a first embodiment of the continuous inkjet system according to this invention and illustrates a normal print condition with some drops in a first charge state, some drops in a second charge state and some merged drops in a third charge state. The pattern of printed drops 46 would correspond to image data from the image source 13 as described with reference to the discussion of FIG. 1.

FIG. 6A-6C shows an alternate embodiment of the continuous inkjet system according to this invention. Shown are cross sectional viewpoints through a liquid jet of in which merged drops and non-deflected drops are guttered with deflected single drops being printed. FIG. 6A shows a sequence of drop pairs in an all print condition, FIG. 6B shows a sequence of drop pairs in a no print condition and FIG. 6C shows a normal print condition in which some of the drops are printed. Parts with the same numbers as in FIG. 5A-5C have the same meaning in all subsequent figures.

In this embodiment, the drop formation device 89 and the velocity modulation device 90 are the same device, a stimulation device 60, made up of a stimulation waveform source 56 and a stimulation transducer 59. The stimulation waveform source 56 provides both the drop formation pulses and velocity modulation pulses to the stimulation transducer 59 to produce perturbations on the liquid jet to cause drops to break off from the liquid jet and also to modulate the velocity of selected drops.

As in the discussion of FIG. 5A-5C the charging pulse source 51 delivers a waveform at half the fundamental frequency of drop formation so that the first drop 36 of a sequential pair of drops is charged by charge electrode 44 to a first charge state and the second drop 35 of the drop pair is charged to a second charge state by the charge electrode 44. In this embodiment, the charge electrode 44 includes a first portion 44*a* and a second portion 44*b* positioned on opposite sides of the liquid jet, with the liquid jets breaking off between the two portions. Typically, the first portion 44*a* and second portion 44*b* of charge electrode 44 are either separate and distinct electrodes or separate portions of the same device. The left and right portions of the charge electrode are biased to the same potential by the charging pulse source 51. The addition of the second charge electrode portion 44*b* on the opposite side of the liquid jet from the first portion 44*a*, biased to the same potential, produces a region between the charging electrode portions 44*a* and 44*b* with an electric field that is almost symmetric left to right about the center of the jet. As a result, the charging of drops breaking off from the liquid jet between the electrodes is very insensitive to small changes in the lateral position of the jet. The near symmetry of the electric field about the liquid jet allows drops to be charged without applying significant lateral deflection forces on the drops near break-off. This provides time for velocity modulated drops in a drop pair to merge before drop deflection fields produced by the deflection device starts to cause their trajectories to diverge. The first and second drops of the selected drop pair combine before the deflection device causes the first drop having a first charge state to travel along the first path and the second drop having the second charge state to travel along the second path. It also enables small satellite drops, which may be formed along with a normal drop, to merge with a normal drop before drop deflection fields cause the satellite drop and normal drop trajectories to diverge sufficiently that they can't merge. In this embodiment, the deflection mechanism 14 includes a deflection electrodes 53 and 63 located below the drop merge location 31 as shown in FIG. 6B. The electrical potential between these two electrodes produces an electric field between the electrodes that deflects negatively charged drops to the left. The strength of the drop deflecting electric field depends on the spacing between these two electrodes and the voltage between them. In this embodiment the deflection electrode 53 is positively biased, and the deflection electrode 63 is negatively biased. By biasing these two electrodes in opposite polarities relative to the grounded liquid jet, it is possible to minimize their contribution to the charge of drops breaking off from the liquid jet.

In this embodiment, a knife edge catcher 67 has been used to intercept the non-print drop trajectories. Catcher 67, which includes a gutter ledge 30, is located below the deflection electrode 53 and deflection electrode 63. The catcher 67 and gutter ledge 30 are oriented such that the catcher intercepts drops traveling along the second path 37 for single uncharged drops as shown in FIG. 6A and also intercepts combined drops 49 traveling along the third path 39 as shown in FIG. 6B, but does not intercept single charged drops 36 traveling along the first path 38. Preferably, the catcher is positioned so that the drops striking the catcher strike the sloped surface of the gutter ledge 30 to minimize splash on impact. The charged drops 36 traveling along the first path 38 are printed on the recording medium 19.

For the discussion below we assume that the charging pulse source 51 delivers a 50% duty cycle square wave waveform at the drop pair frequency $f_p$, which is half the fundamental frequency of drop formation. When electrode 44 has a positive potential on it a negative charge will develop on drop 36 as it breaks off from the grounded jet 43. When there is little or no voltage on electrode 44 during formation of drop 35 there will be little or no charge induced on drop 35 as it breaks off from the grounded jet 43. A positive potential is placed on deflection electrode 53 which will attract negatively charged drops towards the plane of the deflection electrode 53. Placing a negative voltage on deflection electrode 63 will repel the negatively charged drops 36 from deflection electrode 63 which will tend to aid in the deflection of drops 36 toward deflection electrode 53. The fields produced by the applied voltages on the deflection electrodes will provide sufficient forces to the drops 36 so that they can deflect enough to miss the gutter ledge 30 and be printed on recording medium 19. As in the discussion of FIG. 5A-5C velocity modulation is used to cause adjacent drops to combine or merge after being formed at drop merge location 31 shown in FIG. 6B. The combined drops 49 will have essentially the same charge as the charged drops 36, but twice the mass. The combined drops 49 will also be attracted towards deflection electrode 53, but will not be deflected as much as the single drops 36 and they will travel down path 39 and are intercepted by catcher 67 at the gutter ledge 30.

In the embodiment shown in FIG. 6C, an air plenum 61 is formed between the charge electrode and the nozzle plate of the geometry. Air, supplied to the air plenum by an air source (not shown), surrounds the liquid jet and stream of drops as they pass between the first and second portions of the charge electrode, 44*a* and 44*b*, respectively, as indicated by arrows 65. This air flow, moving roughly parallel to the drop trajectories, helps to reduce air drag effects on the drops that can produce drop placement errors.

Figure 7A:
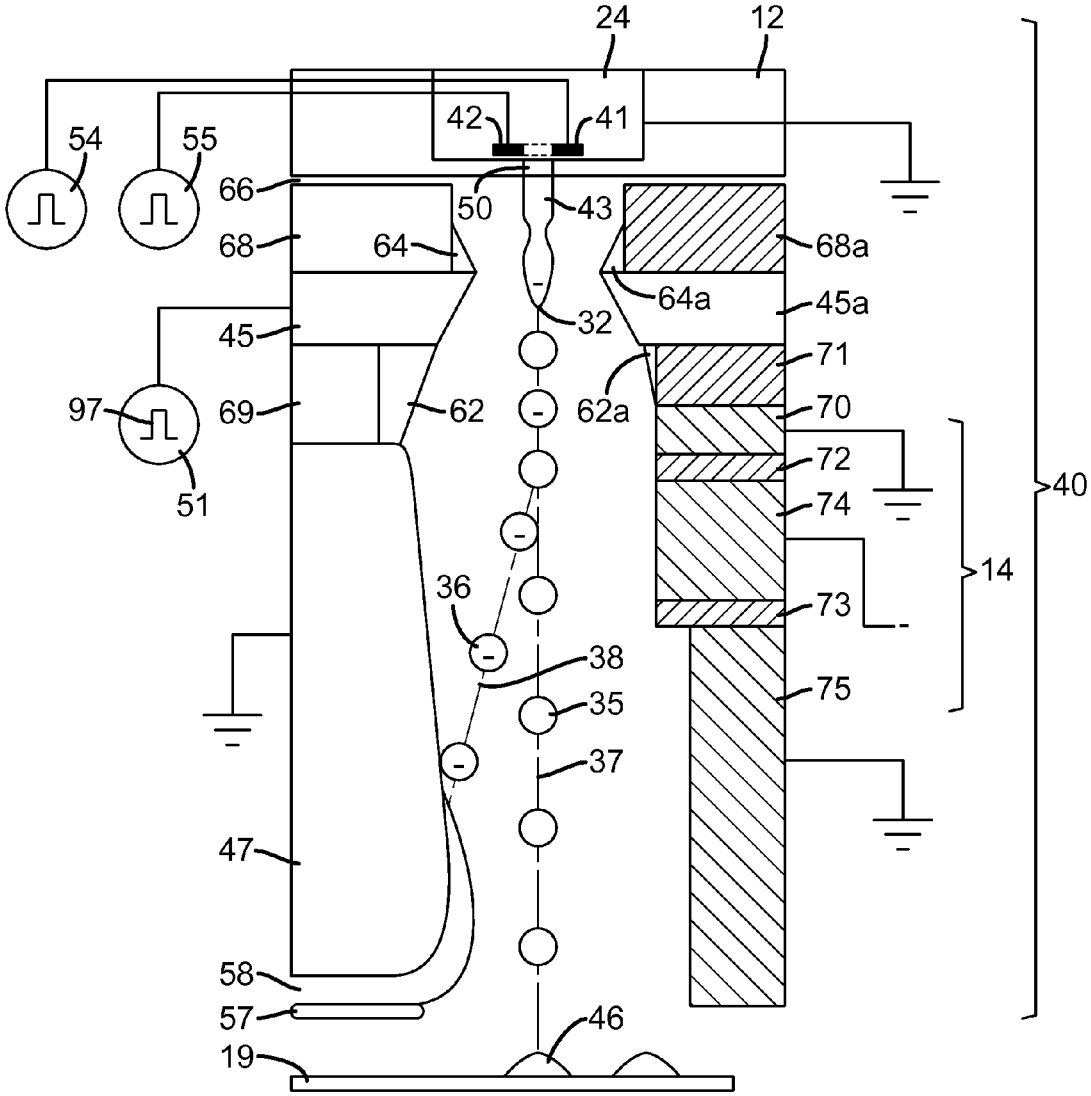
FIG. 7A shows a cross sectional viewpoint through a liquid jet of a second alternate embodiment of the continuous liquid ejection system according to this invention and operating in an all print condition.
Figure 7B:
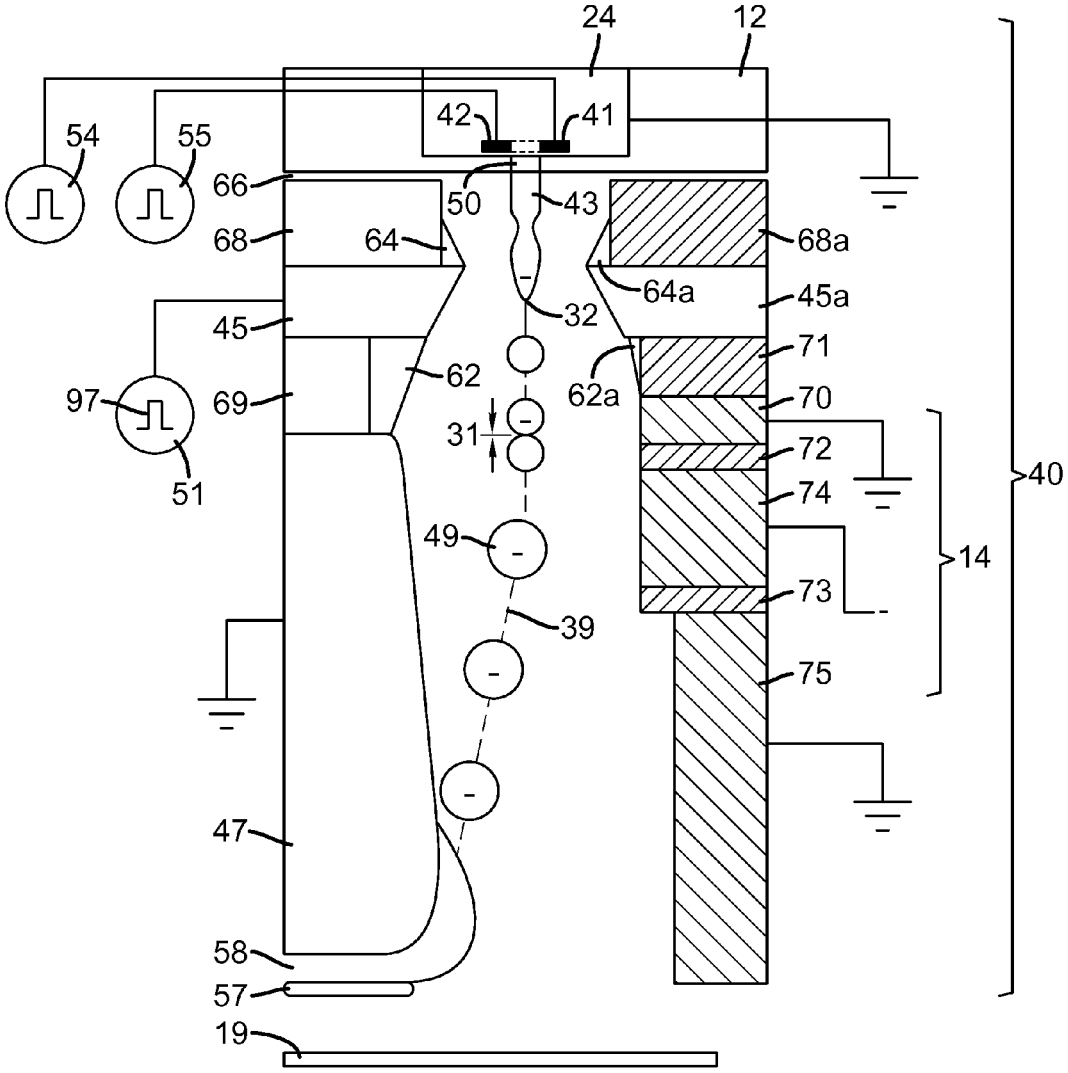
FIG. 7B shows a cross sectional viewpoint through a liquid jet of an alternate embodiment of the continuous liquid ejection system according to this invention and operating in a no print condition.

FIG. 7A-7B shows cross sectional viewpoints through a liquid jet of a second alternate embodiment of a continuous inkjet system according to this invention which shows an integrated electrode and gutter design and illustrates a sequence of drop pairs in an all print condition in FIG. 7A and a sequence of drop pairs in a no print condition in FIG. 7B. All of the components shown on the right side of the jet 43 are optional. Parts with the same numbering as shown in FIG. 5A-5C serve the same functions as described above. Insulator 68 and optional insulator 68*a* are adhered to the top surfaces of charge electrode 45 and optional second charge electrode portion 45*a* respectively and act as spacers to ensure that the charge electrode 45 and optional charge electrode 45*a* are located adjacent to the break off location 32 of liquid jet 43. A gap 66 is present between the top of insulator 68 and the outlet plane of the nozzle 50. The edges of charge electrode 45 and 45*a* facing the jet 43 are angled in FIGS. 7A and 7B to maximize the intensity of the electric field at the break off region which will induce more charge on the charged drops 36. Insulating spacer 69 is also adhered to the bottom surface of charge electrode 45. Optional insulating spacer 71 is adhered to the bottom surface of optional charge electrode 45*a*. The bottom region of insulator 68 has an insulating adhesive 64 in the vicinity of the top surface of charge electrode 45 facing the liquid jet 43. Similarly the bottom region of optional insulator 68*a* has an insulating adhesive 64*a* in the vicinity of the top surface of charge electrode 45*a* facing the liquid jet 43. The insulating spacer 69 also has an insulating adhesive 62 adhering to the side facing the ink jet drops and the bottom surface of electrode 45. Optional insulating spacer 71 also has an insulating adhesive 62*a* adhering to the side facing the ink jet drops and the bottom surface of electrode 45. The purpose of the adhesives 64, 64*a*, 62 and 62*a* is to reduce the likelihood of liquid becoming trapped on the surface of the insulators and to help keep liquid away from the electrode 45 which reduces the possibility of electrical shorting. The grounded gutter 47 is adhered to the bottom surface of insulating spacer 69 and insulating adhesive 64 as shown in FIGS. 7A and 7B. Adhering to the bottom surface of optional insulating spacer 71 is a grounded conductor 70. Another optional insulator 72 adheres to the bottom surface of grounded conductor 70. An optional deflection electrode 74 facing the top region of gutter 47 adheres to the bottom surface of insulator 72. Optional insulator 73 adheres to the bottom surface of deflection electrode 74. Grounded conductor 75 is located adjacent to the bottom region of gutter 47 and is adhered to the bottom surface of insulator 73. Grounded conductor 70 acts as a shield between electrode 45*a* and deflection electrode 74 to isolate the drop charging electric fields near drop break off from the drop deflection fields in front of the catcher. This helps to ensure that the drops as they are breaking off from the jet are not charged as a result of the electric fields produced by the deflection electrode. The purpose of the grounded conductor 75 is to shield the drop impact region of the catcher from electric fields produced by the deflection electrode. The presence of such fields in the drop impact region can contribute to the generation of misting and spray from the gutter 47 surface. The deflection electrode 74 functions in the same manner as the deflection electrode 63 shown in FIG. 6A-6C.

Figure 8:
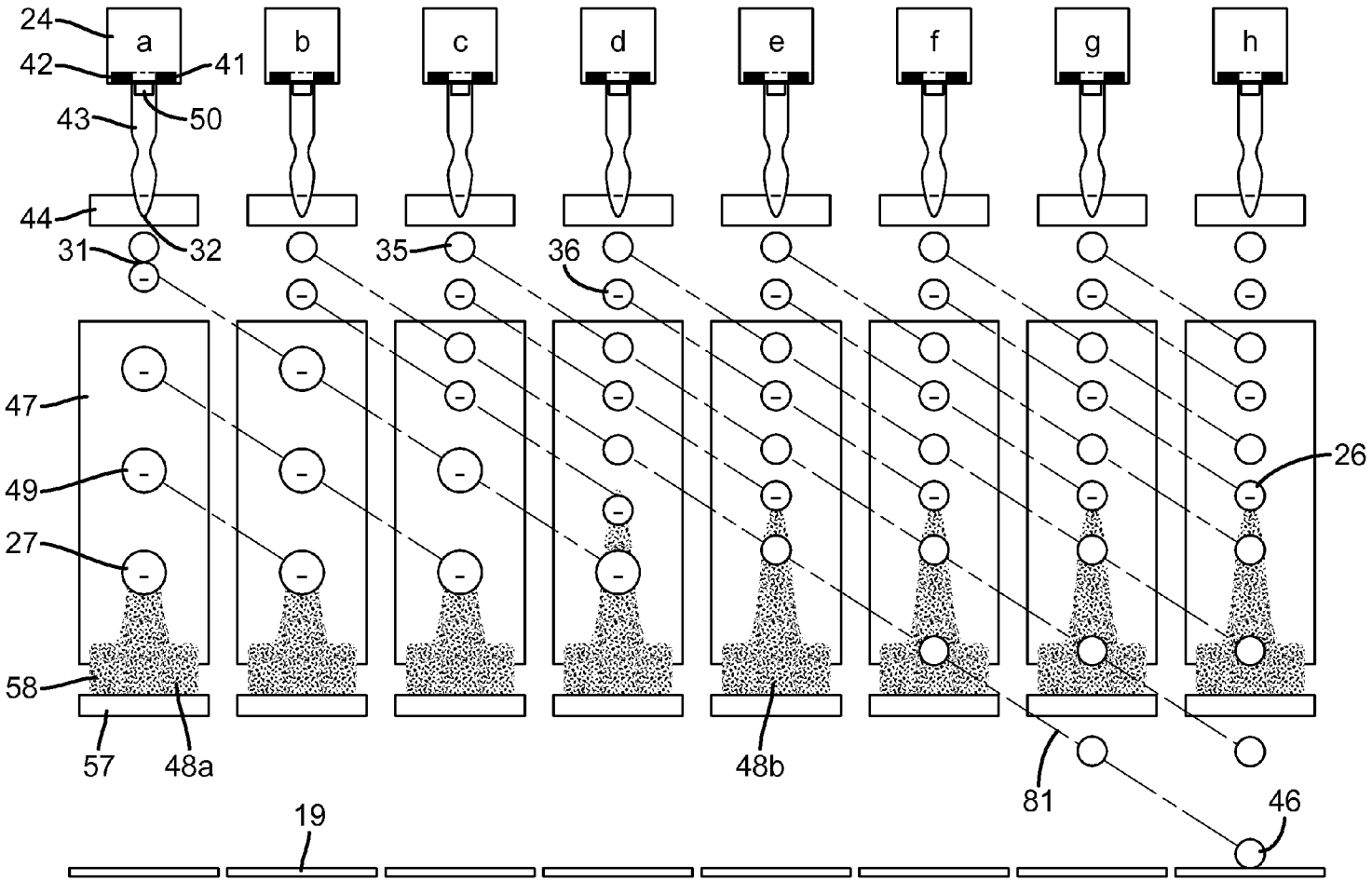
FIG. 8 shows a front view of drops being produced from a jet in a time lapse sequence from a to h producing successive drop pairs according to the continuous liquid ejection system of the invention.

FIG. 8 shows a front view of a stream of drops being produced from a jet in a time lapse sequence from a to h producing successive drop pairs according to the continuous inkjet system of the invention. FIG. 8*a* shows a sequence of non print combined drops 49 being produced which break off from liquid jet 43 at break off location 32 adjacent to charge electrode 44, combining at drop merge location 31 and intercepting the gutter at charged combined drop gutter contact point 27 thus forming an ink film 48*a* that flows down the surface of catcher 47. The ink film flowing down the catcher face, flows around the radius (shown as R in FIG. 5) at the bottom of the catcher face 52 and flows into the ink recovery channel 58 between the catcher 47 and the catcher bottom plate 57, from which it is collected by the ink recycling unit 15 of the printer. The first (lower) drop 36 of the drop pair at the merge location 31 is charged and the second (higher) drop 35 at the merge location is uncharged. The drops are merged by utilizing velocity modulation as described in the discussion of FIG. 5B. Thus combined drops 49 are not printed in this mode of operation. FIG. 8*b* shows the next drop pair being generated to produce a first print drop after a sequence of non print drops. Again the first drop 36 of the drop pair is charged and the second drop 35 of the drop pair is not charged. The uncharged drop is printed and the charged drop is guttered and caught by the catcher 47. FIG. 8*c*-8*h* show successive print drop pairs being generated. Diagonal dotted-dashed lines 81 called drop time lapse sequence indicators indicate the location of the same drop in successive diagrams. The last non-print drop pair being formed in FIG. 8*a* is shown to intercept the catcher at charged combined drop gutter contact point 27 in FIG. 8*d*. The first charged drop 36 of the first print drop pair being formed in FIG. 8*b* is shown to intercept the catcher at charged drop gutter contact point 26 in FIG. 8*d*. The contact point 26 on the catcher for single drops is higher than the contact point for combined drops 27 since the charge to mass ratio is larger in the single drops than in the combined drops. The uncharged print drop 35 of the first print drop pair being formed in FIG. 8*b* is shown to reach the recording medium 19 and be printed as a print drop 46 in FIG. 8*h*.

Figure 9:
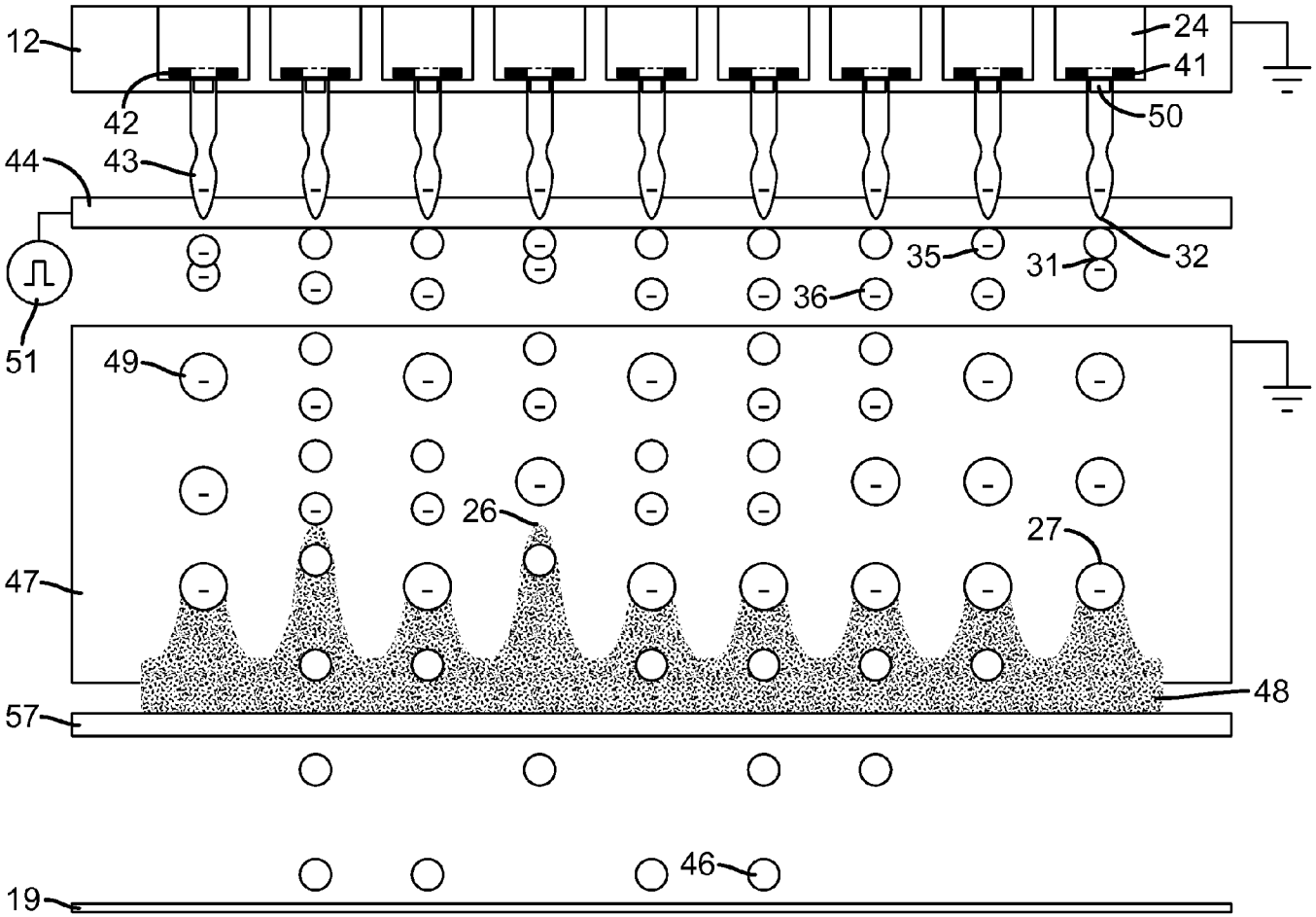
FIG. 9 illustrates a front view point of several adjacent liquid jets of the continuous liquid ejection system of the invention.

FIG. 9 illustrates a front view point of an array of 9 adjacent liquid jets 43 of a printhead 12 of the continuous inkjet system of the invention during printing. The various nozzles show different print and non-print sequences which would occur during normal printing operations. A single charge electrode 44 and a single catcher 47 are common to the entire printhead. The charge electrode 44 is associated with each of the liquid jets from the array of nozzles, being positioned adjacent to the break off locations 32 of the various jets as required for proper operation of this invention. The merge point 31 is below the charge electrode 44 and above the common catcher 47. A continuous ink film 48 is formed across the entire catcher surface when charged drops 36 and charged merged drops 49 intercept the catcher. The ink film 48 on the gutter is collected in the channel between catcher 47 and the common catcher bottom plate 57 and sent to the ink recycling unit of the printer.

Figure 11A:
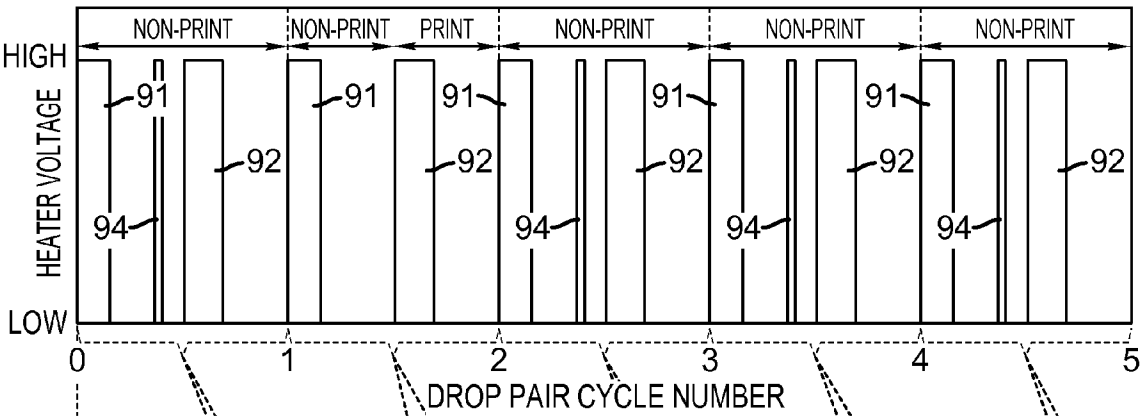
FIG. 11 shows a second example embodiment of a timing diagram illustrating drop formation pulses, velocity modulating pulses, the charge electrode waveform, and the break off of drops.
Figure 11B:
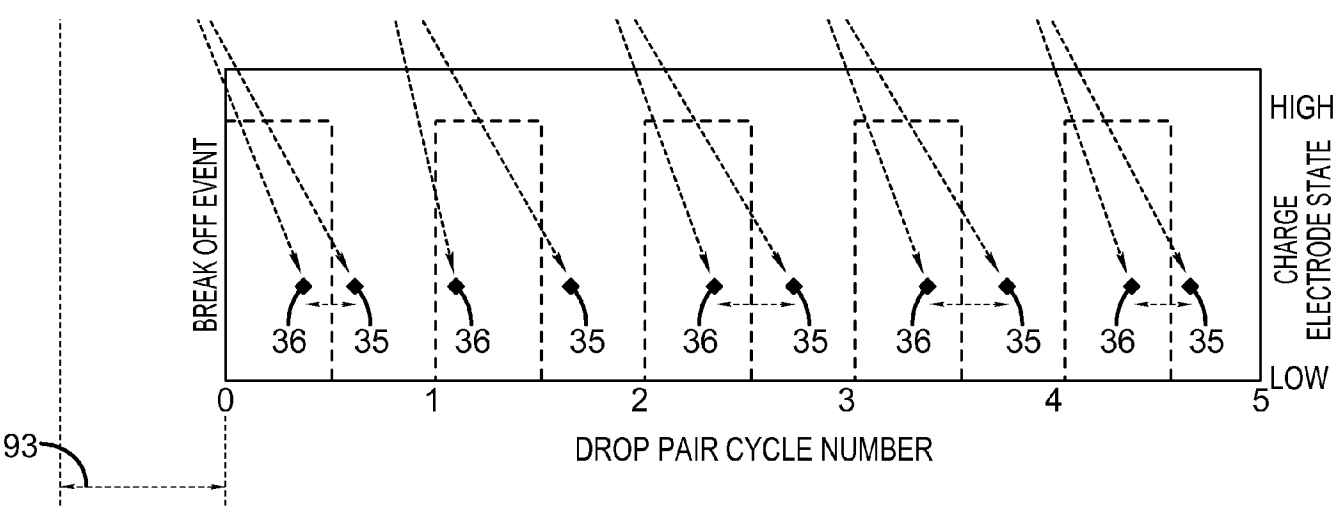
Figure 12A:
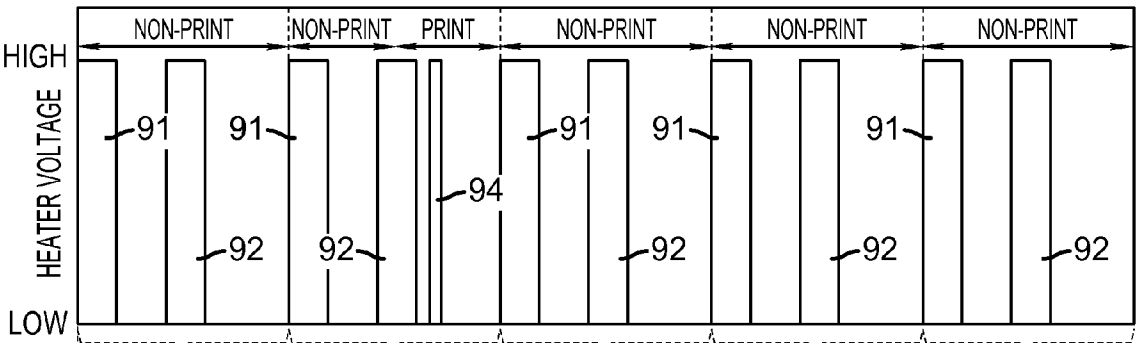
FIG. 12 shows a third example embodiment of a timing diagram illustrating drop formation pulses, velocity modulating pulses, the charge electrode waveform, and the break off of drops.
Figure 12B:
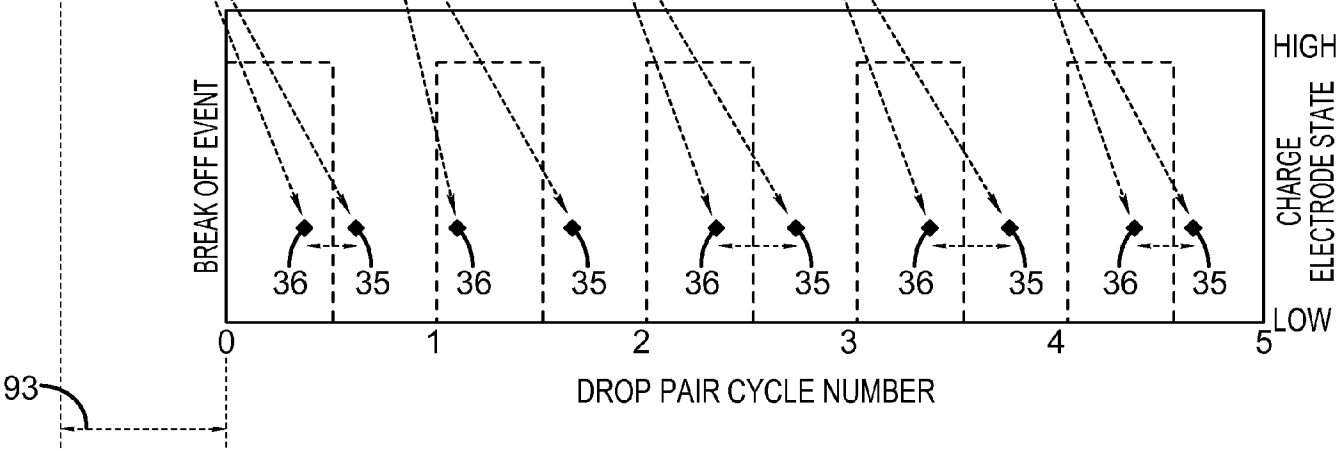

FIGS. 10-12 show timing diagrams of various embodiment illustrating drop formation waveforms, velocity modulating waveforms, the charge electrode waveforms, and the break off timing of drops for the generation of 5 successive drop pair cycles in which the second drop 35 of drop pair in the second drop pair cycle is printed and none of drops in drop pair cycles 1, 3, 4 and 5 are printed. FIG. 10 shows the drop formation pulses, in the upper section of the figure, velocity modulation pulses, in the lower section of the figure, and the drop pairs produced in the center section of the figure. In each section of the figure, the horizontal axis corresponds to time. The top or A section of FIG. 10 shows a sequence of drop formation pulses for a sequence of drop pairs. This drop formation pulses is created by the drop formation source and is applied to the drop formation device transducer. The time axis has been labeled in intervals of drop pair time periods, intervals or cycles, numbered from 1-5. The drop formation device transducer produces perturbations on the liquid jet flowing from the nozzle. As the frequency of these drop formation pulses is less than the cutoff frequency, discussed earlier, and is typically close to the optimum Rayleigh frequency, the perturbations grow until they each cause the end portion of the liquid jet to break off from the liquid jet. Each drop pair interval includes a first drop formation pulse, 91 and a second drop formation pulse 92. The first drop forming pulse 91 in each drop pair interval causes the first drop 36 of the corresponding drop pair to break off from the liquid stream after some delay time. The second drop forming pulse 92 in each drop pair interval causes the second drop 35 of the corresponding drop pair to break off from the liquid stream after a similar delay time. The moment of drop breaking off from the liquid jet is denoted in this figure as a diamond with the reference number for the corresponding drop. In the absence of a velocity modulating pulse, the first and second drops have the same velocity after break off and will not merge.

The middle or B section of FIG. 10 illustrates the time changing voltage V, commonly called a charge electrode waveform 97 supplied by the charge pulse source 51 to the charge electrode 44 along with the times at which the drop break off events occur. The charge electrode waveform 97 as a function of time is shown as the dashed curve and it is shown as a 50% duty cycle square wave going from a high positive voltage to 0 volts with a period equal to the drop pair period, which is twice the fundamental period of drop formation so that one drop pair of two drops is created during one drop charging waveform cycle. The drop charging waveform for each drop pair time interval includes a first voltage state 95, and a second voltage state 96. In this embodiment, the first voltage state corresponds to a high positive voltage and the second voltage state corresponds to 0 volts. In each drop pair time interval, the first drop 36 breaks off during the first voltage state, to produce a first charge state on the first drop. The second drop 35 breaks off during the second voltage state to produce a second charge state on the second drop of each drop pair. Arrows have been drawn in the first drop pair interval from the drop formation pulses shown in the A section of FIG. 10 to the corresponding times at which break off occurs shown in the B section of FIG. 10. To enable the first and second drops to break off during the first and second charge voltage states, respectively, the phase of the charge voltage waveform 97 is phase delayed 93 relative to the phase of the drop formation waveform, shown in the A section of FIG. 10.

The lower or C section of FIG. 10 shows a velocity modulation waveform supplied by the velocity modulation source 54 to a velocity modulation device transducer 42 associated with a nozzle 50. In accordance with the image data to be printed, selected drop pair intervals include velocity modulating pulses 94. The velocity modulation pulse through the action of the velocity modulation transducer creates a perturbation on the jet that causes the velocity of one of both of the first and second drops in a drop pair to be modified such that the first and second drops will merge. Horizontal dotted arrows are shown between the break off event diamonds for the first drop 36 and the second drop 35 in B section of FIG. 10 to indicate drop pairs that will merge due to the application of a velocity modulation pulses shown in the C section of FIG. 10. An arrow has been drawn between the velocity modulation pulse 94 shown in C section of FIG. 10 and the drop pair in B section of FIG. 10 that undergoes velocity modulation due to the velocity modulation pulse 94. In this figure, velocity modulating pulses 94 are shown in the drop pair time intervals 1, 3, 4, and 5. As a result of these velocity modulating pulses 94, the drops velocities are modified to causing the first drop to merge with the second drop in each of these drop pair time intervals. The second drop pair time interval corresponds to creating a pair of drops, a charged drop 36 which is guttered followed by an uncharged drop 35 which is printed and no velocity modulating pulse 94 is present during this time interval. While this figure shows the velocity modulation pulse to be timed to occur between the first and second drop forming pulses of the drop pair interval, the invention is not limited to such a timing of the velocity modulation pulse. For example it is anticipated that the velocity modulation pulse can partially or completely overlap or be concurrent with the second drop forming pulse of the drop pair.

With reference to FIG. 11, the top section A of FIG. 11 shows a chart illustrating a sequence of pulses from a waveform source, which serves as both the drop formation source and the velocity modulation source, to a heater, which serves as both the drop formation device transducer and velocity modulation device transducer, located at a nozzle of a thermally stimulated print head version of the CIJ printing system of the invention. The bottom section B of FIG. 11 shows corresponding relative timing of the moments at which the respective drops formed by these pulses break off from the liquid stream. The top section A of FIG. 11 thus shows a timing diagram of the heater voltage versus time applied to the drop formation waveform source 55 to stimulate the thermal stimulation drop formation device transducer 42, shown in FIG. 5A-7B. The time axis is marked out in intervals of drop pair periods, which are twice the fundamental period of drop formation. Each drop pair period, or cycle 1-5 of the drop formation waveform includes a portion of the waveform that leads to the formation of the first drop, a first drop forming pulse 91, and other portion of the waveform that leads to the formation of the second drop, a second drop forming pulse 92. The first drop forming pulse 91 in each drop pair cycle causes the first drop 36 of the corresponding drop pair to break off from the liquid stream after some delay time. The second drop forming pulse 92 in each drop pair cycle causes the second drop 35 of the corresponding drop pair to break off from the liquid stream. The frequency of the drop forming pulses is preferably close to the optimum frequency $F_{opt}$ for drop formation, discussed earlier. In selected drop pair cycles, 1, 3, 4, and 5, a velocity modulation pulse 94 is also present. The velocity modulation pulse 94 is narrower than the drop forming pulses 91 and 92. The timing of the velocity modulation pulse 94 between the drop forming pulses 91 and 92 is such that the velocity modulation pulse does not cause a separate drop to be formed. That is the time of the velocity modulation pulse 94 relative to at least one of the first and second drop forming pulses 91 and 92 is such that the perturbation produced by the velocity modulation pulse won't grow to cause a drop to form. In effect, the instantaneous frequency of pulses exceeds the Rayleigh cutoff frequency $F_R$.

The bottom chart B in FIG. 11 illustrates the time changing voltage V supplied by the charge pulse source 51 to the charge electrode 44 along with the times at which the drop break off events occur. The voltage waveform profile as a function of time is shown as the dashed curve and it is shown as a 50% duty cycle square wave going from a high positive voltage to 0 volts with a period equal to the drop pair period, which is twice the fundamental period of drop formation so that one drop pair of two drops is created during one voltage cycle. The drop charging waveform for each drop pair time interval includes a first voltage state, and a second voltage state. In this embodiment, the first voltage state corresponds to a high positive voltage and the second voltage state corresponds to 0 volts. In each drop pair time interval, the first drop 36 breaks off during the first voltage state, to produce a first charge state on the first drop. The second drop 35 breaks off during the second voltage state to produce a second charge state on the second drop of each drop pair. To enable the first and second drops to break off during the first and second charge voltage states, respectively, the phase of the charge voltage waveform is phase delayed 93 relative to the phase of the drop formation waveform. The non-print drop pairs shown in the top chart A of FIG. 5 in drop cycle pairs 1, 3, 4 and 5 correspond to creating pairs of drops, a charged drop 36 followed by an uncharged drop 35 which merges to form combined charged drop 49 which is guttered. The combination of the second drop forming pulse 92 and the velocity modulating pulse 94 increases the velocity of the second drop 35 of the drop pair relative to that of the first drop 36 of the drop pair, causing the two drops to merge to form a combined charged drop 49. The dashed arrows indicate drops that will merge further downstream. The start of the heater voltage pulse is separated in time by the fundamental period between the first charged drops 36 and second uncharged drops 35. Non-print heater voltage cycles are identical for drop pair cycles 1, 3, 4 and 5 shown in FIG. 11.

The second drop pair cycle corresponds to creating a pair of drops, a charged drop 36 which is guttered followed by an uncharged drop 35 which is printed. The first heater pulse of the second drop pair formation cycle corresponds to the formation of the first drop 36 of the drop pair which breaks off when the high voltage to the charge electrode is on. The second heater voltage pulse of the second drop pair formation cycle corresponds to the formation of the second drop 35 of the drop pair which breaks off when the high voltage to the charge electrode is off. The start of the heater voltage pulses between the first charged drop 36 and second uncharged drop 35 is separated in time by the fundamental period and the two pulses have the same energy. This causes the velocity of the two drops to be close to the same so that they will not merge as they travel downstream from the printhead. The dotted arrows going from the top chart A to the bottom chart B show which drops are created during each drop pair print cycle.

In FIG. 11, the velocity modulation pulse 94 is shown as occurring in the time interval between the first drop formation pulse and the second drop formation pulse. The invention is not limited to such a timing of the velocity modulation pulse. For example it is anticipated that the velocity modulation pulses that partially or completely overlap or be concurrent with the second drop forming pulse of the drop pair to, in effect, increase the pulse width of the second drop formation pulse to increase the pulse amplitude of at least a portion of the second drop formation pulse, can be effectively employed to cause the first drop and the second drop of a drop pair to merge.

The velocity modulation pulse 94 produces the desired modulation of the drop velocities to allow the first drop 36 and the second drops 35 of a drop pair to merge. As indicated in FIG. 11, the velocity modulation pulse does also produce some shift in the break off phase of one or both of the first and second drops. The shifts in break off phase do not produce a change in the charge state of either the first or second drops. The small phase shifts produced by the velocity modulation pulse do not cause the first drop to break off during the second voltage state instead of the normal first voltage state, nor do they cause the second drop to break off during the first voltage state instead of the normal second voltage state.

In the embodiments discussed above the first drop 36 and the second drop 35 of drop pair 34 have substantially the same volume. The formation of a drop pair 34 or a large drop 49 occurs with a drop pair period $T_p=2T_o$. This enables efficient drop formation and the capability to print at the highest speeds. In other embodiments the volumes of the first and second drops of the drop pairs may be different and the drop pair period $T_p$ of formation of a drop pair 34 or a large drop 49, is greater than $2T_o$ where $T_o$ defines the period of smaller of the two drops in the drop pair. As examples the first and second drops of the drop pair may have a ratio of their volumes of 4/3 or 3/2 corresponding to drop pair periods $T_p$ of $7T_o/3$ or $5T_o/3$. The size of the smallest possible drop is determined by the Rayleigh cutoff frequency $F_R$. In such embodiments the period of the charge electrode waveform will be equal to the drop pair period of formation of a drop pair 34 or large drop 49.

FIG. 12 illustrates such an embodiment in which the first and second drops in the drop pair do not have the same volume. As with FIGS. 10 and 11, the time axis is marked out in drop pair cycles or periods. Each drop pair cycle includes a first drop forming pulse 91 and a second drop-forming pulse. The time between the first and second drop forming pulse 91 and 92 within a drop pair cycle is less than the time between the second drop forming pulse 92 and the first drop forming pulse 91 of the subsequent drop pair cycle. As a result the first drop of the drop pair is larger than the second drop of the drop pair. The non-uniform time between the first and second drop forming pulses can produces a velocity difference between the first and second drops of the drop pair. With such a velocity difference, the first and second drops of the drop pair can merge without the use of a velocity modulation pulse. A velocity modulating pulse 94 can then be used to prevent the drops of the drop pair from merging, as is shown in the second drop pair cycle.

In a binary printer utilizing the inventions of this disclosure only two types of drop cycle pairs are required to print any pattern. They are a non-print cycle pair and a print cycle pair consisting of a non-print drop followed by a print drop. Generally this invention can be practiced to create print drops in the range of 1-100 pl, with nozzle diameters in the range of 5-50 μm, depending on the resolution requirements for the printed image. The jet velocity is preferably in the range of 10-30 m/s. The fundamental drop generation frequency is preferably in the range of 50-1000 kHz.

The invention allows drops to be selected for printing or non-printing without the need for a separate charging electrode to be used for each liquid jet in an array of liquid jets. Instead a single charging electrode can be used to charge drops from all the liquid drops in an array. This eliminates the need to critically align of the charging electrodes with the nozzles. Crosstalk charging of drops from one liquid jet by means of a charging electrode associated with a different liquid jet is not an issue. Since crosstalk charging is not an issue, it is not necessary to minimize the spacing between the charge electrodes and the liquid jets as is required for traditional drop charging systems. Spacing of the charge electrode from the jet axis in the range of 25-300 μm is useable. The elimination of the individual charge electrode for each liquid jet allows for high densities of nozzles than traditional electrostatic deflection continuous inkjet system, which require separate charge electrodes for each nozzle. The nozzle array density can be in the range of 75 nozzles per inch (npi) to 1200 npi.

Figure 13:
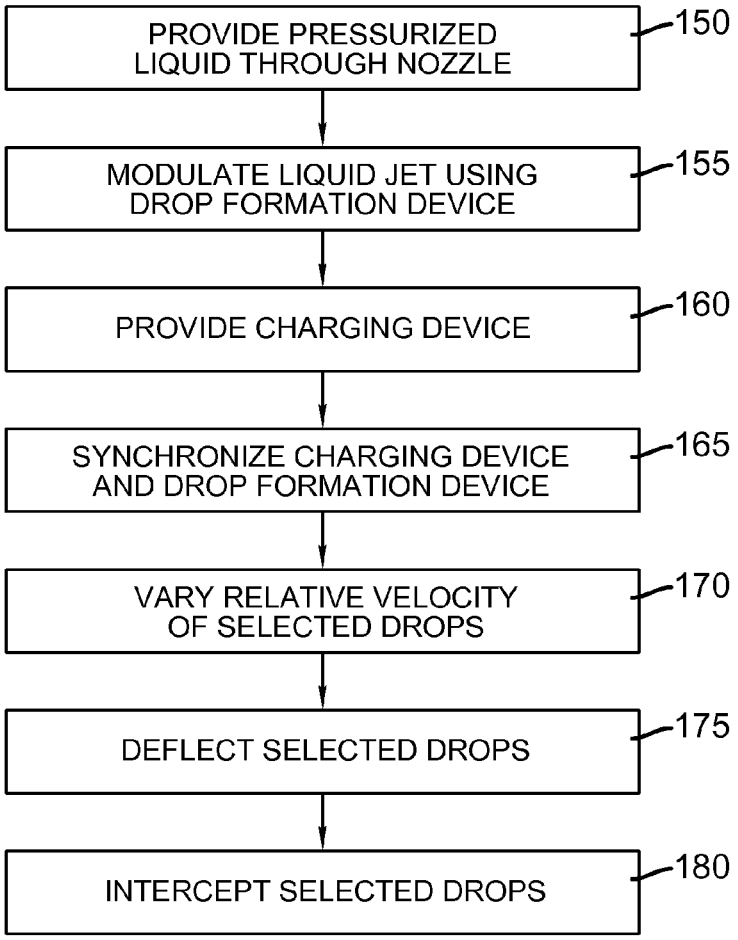
FIG. 13 is a block diagram of a method of drop ejection according to an example embodiment of the invention.

Referring to FIG. 13, a method of ejecting liquid drops begins with step 150. In step 150, liquid is provided under a pressure that is sufficient to eject a liquid jet through a nozzle of a liquid chamber. Step 150 is followed by step 155.

In step 155, the liquid jet is modulated using a drop formation device to cause portions of the liquid jet to break off into a series of drop pairs, including a first drop and a second drop, traveling along a path. Each drop pair is separated in time on average by a drop pair period. Step 155 is followed by step 160.

In step 160, a charging device is provided. The charging device includes a charge electrode and a source of varying electrical potential. The charge electrode is associated with the liquid jet. The source of varying electrical potential varies the electrical potential between the charge electrode and the liquid jet by providing a waveform to the charge electrode. The waveform includes a period that is equal to the drop pair period, a first distinct voltage state, and a second distinct voltage state. Step 160 is followed by step 165.

In step 165, the charging device and the drop formation device are synchronized to produce a first charge state on the first drop and produce a second charge state on the second drop. Step 165 is followed by step 170.

In step 170, the relative velocity of a first drop and a second drop of a selected drop pair is varied using a drop velocity modulation device to control whether the first drop and the second drop of the selected drop pair combine with each other to form a combined drop. The combined drop has a third charge state. Step 170 is followed by step 175.

In step 175, a deflection device is used to cause the first drop having the first charge state to travel along a first path, the second drop having the second charge state to travel along a second path, and the combined drop having a third charge state to travel along a third path. Step 175 is followed by step 180.

In step 180, a catcher is used to intercept drops traveling along one of the first path or the second path. The catcher is also used to intercept drops traveling along the third path.

It is to be noted that the waveform supplied to the drop formation device in step 155 and the waveform supplied to the charge electrode in step 160 are independent of the image data, while the waveform supplied to the velocity modulation device in step 170 depends on the image data.

The invention has been described in detail with particular reference to certain example embodiments thereof, but it will be understood that variations and modifications can be effected within the scope of the invention.

PARTS LIST

10 Continuous Inkjet Printing System
11 Ink Reservoir
12 Printhead or Liquid Ejector
13 Image Source
14 Deflection Mechanism
15 Ink Recycling Unit
16 Image Processor
17 Logic Controller
18 Stimulation controller
19 Recording Medium
20 Ink Pressure Regulator
21 Media Transport Controller
22 Transport Rollers
24 Liquid Chamber
26 Charged Drop Gutter Contact point
27 Charged Combined Drop Gutter Contact point
30 Gutter Ledge
31 Drop Merge Location
32 Break off Location
34 Drop Pair
35 Second Drop
36 First Drop
37 Second Path
38 First Path
39 Third Path
40 Continuous Liquid Ejection System
41 Velocity Modulation Device Transducer
42 Drop Formation Device Transducer
43 Liquid Jet
44 Charge electrode
**44*a*** Second Charge Electrode
45 Charge Electrode
**45*a*** Second Charge Electrode
46 Printed Drop
47 Catcher
48 Ink Film

48*a* Merged Drop Ink Film
48*b* Single Drop Ink Film
49 Combined Drops
50 Nozzle
51 Charging Pulse Source
52 Catcher Face
53 Deflection Electrode
54 Velocity Modulation Source
55 Drop Formation Waveform Source
56 Stimulation Waveform Source
57 Catcher Bottom Plate
58 Ink Recovery Channel
59 Stimulation Transducer
60 Stimulation Device
61 Air Plenum
62 Insulating Adhesive
62*a* Second Insulating Adhesive
63 Deflection Electrode
64 Insulating Adhesive
64*a* Second Insulating Adhesive
65 Arrow
66 Gap
67 Catcher
68 Insulator
68*a* Insulator
69 Insulator
70 Grounded Conductor
71 Insulator
72 Insulator
73 Insulator
74 Deflection Electrode
75 Grounded Conductor
81 Drop Time Lapse Sequence Indicator
83 Charging Device
87 Liquid Jet Central Axis
89 Drop Formation Device
90 Velocity Modulation Device
91 First Drop Forming Pulse
92 Second Drop Forming Pulse
93 Phase Delay
94 Velocity Modulating. Pulse
95 First Voltage State
96 Second Voltage State
97 Charge Electrode Waveform
150 Provide Pressurized Liquid through Nozzle Step
155 Modulate Liquid Jet using Drop Formation Device Step
160 Provide Charging Device Step
165 Synchronize Charging Device and Drop Formation Device Step
170 Vary Relative Velocity of Selected Drop Pairs Step
175 Deflect Drops Step
180 Intercept Selected Drops Step

The invention claimed is:

1. A method of ejecting liquid drops comprising:

providing liquid under pressure sufficient to eject a liquid jet through a nozzle of a liquid chamber;

modulating the liquid jet to cause portions of the liquid jet to break off into a series of drop pairs traveling along a path using a drop formation device, each drop pair separated in time on average by the drop pair period, each drop pair including a first drop and a second drop;

providing a charging device including:

a charge electrode associated with the liquid jet; and a source of varying electrical potential between the charge electrode and the liquid jet, the source of varying electrical potential providing a waveform, the waveform including a period that is equal to the drop pair period, the waveform including a first distinct voltage state and a second distinct voltage state;

synchronizing the charging device with the drop formation device to produce a first charge state on the first drop and to produce a second charge state on the second drop;

varying a relative velocity of a first drop and a second drop of a selected drop pair using a drop velocity modulation device to control whether the first drop and the second drop of the selected drop pair combine with each other to form a combined drop, the combined drop having a third charge state; and causing the first drop having the first charge state to travel along a first path, causing the second drop having the second charge state to travel along a second path, and causing the combined drop having a third charge state to travel along a third path using a deflection device.

2. The method of claim 1, wherein the first drop and the second drop of the selected drop pair combine prior to being acted upon by the deflection device that causes the first drop in the first charge state to travel along the first path and the second drop in the second charge state to travel along the second path.

3. The method of claim 1, wherein the third path is different when compared to the first path and the second path.

4. The method of claim 1, further comprising:

intercepting drops traveling along one of the first path and the second path using a catcher; and intercepting drops traveling along the third path using the catcher.

5. The method of claim 1, wherein the first drop and the second drop of the selected drop pair combine after the deflection device causes the first drop to begin traveling along the first path and the second drop to begin traveling along the second path.

6. The method of claim 1, the nozzle being one of an array of nozzles, and the charge electrode of the charging device being an electrode common to and associated with each of the liquid jets being ejected from each nozzle of the nozzle array.

7. The method of claim 1, wherein the first drop and the second drop have substantially the same volume.

8. The method of claim 1, wherein the drop formation device and the drop velocity modulation device are the same device.

9. The method of claim 1, wherein the drop formation device further comprises:

a drop formation transducer associated with one of the liquid chamber, the nozzle, and the liquid jet; and a waveform source that supplies a drop formation waveform to the drop formation transducer.

10. The method of claim 9, wherein the drop formation transducer is one of a thermal device, a piezoelectric device, a MEMS actuator, and an electrohydrodynamic device, an optical device, an electrostrictive device, and combinations thereof.

11. The method of claim 9, wherein the drop formation waveform includes a first portion that creates the first drop of the drop pair and a second portion that creates the second drop of the drop pair.

12. The method of claim 1, wherein the drop velocity modulation device further comprises:

a drop velocity modulation transducer associated with one of the liquid chamber, the nozzle, and the liquid jet; and a waveform source that supplies a drop velocity modulation waveform to the drop velocity modulation transducer.

13. The method of claim 12, wherein the drop velocity modulation transducer is one of a thermal device, a piezoelectric device, a MEMS actuator, and an electrohydrodynamic device, an optical device, an electrostrictive device, and combinations thereof.

14. The method of claim 12, wherein the drop velocity modulation waveform supplied to the drop velocity modulation transducer is responsive to print data supplied by a stimulation controller.

15. The method of claim 1, wherein one of the first drop and the second drop is uncharged relative to the charge associated with the other of the first drop and the second drop.

16. The method of claim 1, wherein the source of varying electrical potential between the charge electrode and the liquid jet is not responsive to print data supplied by a stimulation controller.

17. The method of claim 1, wherein the source of varying electrical potential between the charge electrode and the liquid jet produces a waveform in which the first distinct voltage state and the second distinct voltage state are each active for a time interval equal to the fundamental period.

18. The method of claim 1, wherein the deflection device further comprises at least one deflection electrode to deflect charged drops, the at least one deflection electrode being in electrical communication with one of a source of electrical potential and ground.

19. The method of claim 1, wherein the charging device comprises a charge electrode including a first portion positioned on a first side of the liquid jet and a second portion positioned on a second side of the liquid jet.

20. The method of claim 1, wherein the deflection device further comprises a deflection electrode in electrical communication with a source of electrical potential that creates a drop deflection field to deflect charged drops.

21. The method of claim 1, wherein the liquid includes ink for printing on a recording medium.

22. The method of claim 1, wherein the second distinct voltage state includes a DC offset.

* * * * *